US012588797B2

(12) United States Patent
Lee et al.

(10) Patent No.: US 12,588,797 B2
(45) Date of Patent: Mar. 31, 2026

(54) CUP WASHER

(71) Applicant: LG ELECTRONICS INC., Seoul (KR)

(72) Inventors: Minhyuk Lee, Seoul (KR); Sung Hun Lee, Seoul (KR); Woongsup Song, Seoul (KR); Taeyong Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 44 days.

(21) Appl. No.: 18/434,004

(22) Filed: Feb. 6, 2024

(65) Prior Publication Data

US 2025/0185875 A1 Jun. 12, 2025

(30) Foreign Application Priority Data

Dec. 12, 2023 (KR) ..... 10-2023-0180144

(51) Int. Cl.

| | |
|---|---|
| ***A47L 15/00*** | (2006.01) |
| ***A47L 15/42*** | (2006.01) |
| ***A47L 15/44*** | (2006.01) |
| ***F04B 43/09*** | (2006.01) |
| ***F04B 43/12*** | (2006.01) |

(52) U.S. Cl.

CPC ..... *A47L 15/449* (2013.01); *A47L 15/0065* (2013.01); *A47L 15/4246* (2013.01); *A47L 15/44* (2013.01); *A47L 15/4418* (2013.01); *F04B 43/1246* (2013.01); *A47L 2401/02* (2013.01); *A47L 2501/07* (2013.01); *F04B 43/09* (2013.01)

(58) Field of Classification Search

None

See application file for complete search history.

(56) References Cited

FOREIGN PATENT DOCUMENTS

| | | | |
|---|---|---|---|
| CN | 110367905 | A | 10/2019 |
| EP | 2 044 877 | A1 | 4/2009 |
| EP | 3 683 349 | A1 | 7/2020 |
| KR | 10-0390806 | B1 | 7/2003 |
| KR | 10-2114048 | B1 | 5/2020 |
| KR | 10-2022-0003756 | A | 1/2022 |
| WO | WO 2020/047881 | A1 | 3/2020 |
| WO | WO 2023/274943 | A1 | 1/2023 |

*Primary Examiner* — Levon J Shahinian

(74) *Attorney, Agent, or Firm* — Birch, Stewart, Kolasch & Birch, LLP

(57) ABSTRACT

Disclosed is a cup washer. The cup washer of the present disclosure includes an additive storage part and an additive supply part. The additive storage part is configured to store an additive in a storage space. The additive supply part is configured to supply the additive into the tub. The additive supply part includes an additive pump and a first additive supply pipe. The additive pump is located below the additive storage part. The first additive supply pipe connects the lower portion of the additive storage part to the inlet of the additive pump. The first additive supply pipe is configured to provide a first supply passage through which the additive of the additive storage part moves toward the inlet of the additive pump. The first additive supply pipe and the inlet are connected to each other at a predetermined angle.

16 Claims, 17 Drawing Sheets

CUP WASHER

CROSS-REFERENCE TO RELATED APPLICATION(S)

This application is based on and claims priority under 35 U.S.C. 119 to Korean Patent Application No. 10-2023-0180144, filed on Dec. 12, 2023, in the Korean Intellectual Property Office, the disclosure of which is herein incorporated by reference in its entirety.

BACKGROUND OF THE INVENTION

1. Field of the Invention

The present disclosure relates to a cup washer, and more specifically, to a cup washer that washes a cup by spraying water.

2. Description of the Prior Art

A cup washer is a device that washes a cup by spraying water. Recently, as the awareness of practicing carbon neutrality has expanded throughout society, the number of people carrying personal or reusable cups has increased. Accordingly, the number of government offices, companies, and stores where cup washers are installed for the hygiene and convenience of users (employees) is increasing.

Korean Patent No. 2114048 (hereinafter, referred to as "Prior Art Document 1") discloses a "compact automatic cup washer" which includes a housing, a support pad, a rotating frame, an external nozzle, an external brush, a sterilizing and drying unit, a detergent storage unit, and a pipe opening and closing unit. The pipe opening and closing unit includes a first valve configured to open and close a supply pipe through which washing water is supplied, and a third valve configured to open and close a passage between the detergent storage unit and the supply pipe. The detergent storage unit is a tank in which a liquid detergent is stored.

According to Prior Art Document 1, since the detergent is supplied to the supply pipe only by opening the third valve by a controller, there is a limitation in precisely controlling the amount of detergent supplied to the supply pipe.

Regarding detergent input technology, International Patent Publication No. WO2023/274943 (hereinafter, referred to as "Prior Document 2") discloses a "dishwasher detergent dispenser". The dishwasher detergent dispenser is installed in a dishwasher.

An internal washing chamber in the dishwasher is opened and closed by a door. The detergent dispenser is installed on the inner wall of the door. The detergent dispenser includes a housing compartment, a supply container, and a delivery mechanism (a pump unit or a pump driver). The pump driver and the housing compartment are first coupled to the inner wall of the door, and then the supply container is coupled to the housing compartment. At this time, the pump unit is coupled between the supply vessel and the housing compartment. The supply container defines a space inside which the detergent is filled (hereinafter, referred to as a "filling space").

The pump driver includes an electric motor and a drive shaft. The pump unit includes a flexible tube, a rotor, and a plurality of pump elements (a plurality of rollers). When the electric motor rotates, the pump elements connected to the drive shaft rotate to pressurize the flexible tube, and the detergent in the flexible tube flows out into the washing chamber.

According to Prior Art Document 2, the inlet and outlet of the pump unit are located below the drive shaft, and the upper portion of the flexible tube is higher than the lower portion of the filling space. Therefore, the detergent in the filling space rises along the flexible tube, then falls, and then flows out into the washing chamber. Therefore, when the height of the detergent in the filling space is lower than the upper portion of the flexible tube, all of the detergent in the filling space may not flow out into the washing chamber through the flexible tube, and the remaining amount may remain in the filling space and the lower portion of the flexible tube.

According to Prior Art Document 2, the pump driver, the housing compartment, the pump unit, and the supply container are sequentially assembled to the inner wall of the door. Therefore, to repair or replace the pump driver, it is necessary to remove all of the housing compartment, the pump unit, and the supply container from the inner wall of the door. Therefore, it takes a long time to maintain the pump driver. Additionally, when the pump unit is separated during this process, there is a possibility that some of the detergent may leak out from the inlet and outlet of the pump unit.

The amount of detergent that flows out into the washing chamber through a flexible tube is generally proportional to the rotation amount of a pump element (roller). However, according to Prior Art Document 2, the amount of detergent flowing into the washing chamber is controlled by controlling the operation (time) of the electric motor. Therefore, there are limitations in precisely controlling the amount of the detergent flowing into the washing chamber.

SUMMARY OF THE INVENTION

The present disclosure is to solve the above-described problems of a cup washer that washes a cup by spraying water.

Specifically, the present disclosure is to provide a cup washer in which an additive storage and input structure is optimized such that the entire additive stored therein can be introduced into a pump and the entire additive discharged by the pump can be put into a tub.

In addition, the present disclosure is to provide a cup washer in which a pump assembly structure is simplified and optimized so that the pump can be more easily and efficiently maintained and managed.

Furthermore, the present disclosure is to provide a cup washer in which the amount of pressurization of a tube can be correctly monitored and the amount of the additive to be put into the tub can be precisely controlled.

The technical problems to be addressed by the present disclosure are not limited to those described above, and other technical problems, which are not described above, will be clearly understood by a person ordinarily skilled in the related art to which the present disclosure belongs.

The present application discloses a cup washer that washes cups by spraying water into a tub, wherein the cup washer may include an additive storage part and an additive supply part.

The additive storage part may store an additive in the storage space.

The additive supply part may supply the additive into a tub.

The additive supply part may include an additive pump and a first additive supply pipe.

The additive pump may be placed below the additive storage part.

The first additive supply pipe may connect the lower portion of the additive storage part to the inlet to provide a first supply passage through which the additive of the additive storage part moves toward the inlet of the additive pump.

The first additive supply pipe and the inlet may be connected at a predetermined angle.

The additive supply part may include a pump housing.

The pump housing is located lower than the bottom of the storage space and may accommodate an additive pump therein.

The first additive supply pipe may be coupled to the additive storage part and the pump housing.

An additive discharge hole into which the first additive supply pipe is vertically inserted may be provided in the lower portion of the additive storage part.

A pair of sealing members may be interposed between the outer surface of the first additive supply pipe and the inner surface of the additive discharge hole, wherein the pair of sealing members may be vertically spaced apart from each other within the additive discharge hole.

The additive supply part may include a second additive supply pipe.

The second additive supply pipe may be connected to the outlet to provide a second supply passage through which the additive discharged from the outlet of the additive pump located below the inlet moves to the outside of the pump housing.

The second additive supply pipe and the outlet may be connected at a predetermined angle.

The first additive supply pipe and the second additive supply pipe may be configured as a single supply pipe.

Alternatively, the first additive supply pipe and the second additive supply pipe may be configured as separate supply pipes. The first additive supply pipe and the second additive supply pipe may be manufactured separately and coupled in the form of a longitudinally long pipe in appearance.

The first supply passage and the second supply passage may be partitioned by a pipe wall located between the heights of the inlet and outlet.

The pipe wall may be placed at a height closer to the inlet than the outlet.

The additive pump may include an additive tube and a rotating roller.

The additive tube may include an inlet and an outlet.

The rotating roller may be rotated by the additive motor to pressurize the additive tube.

A power shaft configured to transmit the torque of the additive motor to the rotating roller may be provided between the heights of the inlet and the outlet.

The additive tube may have a shape bent between the inlet and the outlet.

The pump housing may include a housing body, a first housing cover, and a second housing cover.

The housing body may include an intermediate partition through which the power shaft passes, and the intermediate partition may partition a first accommodation space configured to accommodate the additive pump and a second accommodation space configured to accommodate the additive motor.

The first housing cover may be configured to open and close the first accommodation space.

The second housing cover may be configured to open and close the second accommodation space.

The first housing cover and the second housing cover may be coupled to the lower portion of the additive storage part from opposite sides with respect to the first additive supply pipe.

The additive pump may include a magnetic force member and a magnetic force detector.

The magnetic member may be configured to be rotated by the additive motor.

The magnetic force detector may be provided on one side of the rotation path of the magnetic force member to detect the rotation of the rotating roller.

The amount of the additive added may be controlled by a signal from the magnetic force detector.

The first additive supply pipe and the inlet may be connected at an angle of 90 degrees.

The second additive supply pipe and the outlet may be connected at an angle of 90 degrees.

The second additive supply pipe may be coupled with the pump housing.

The additive supply part may include an additive transfer pipe.

The additive transfer pipe may connect the second additive supply pipe to the tub to supply the additive into the tub from below the outlet.

The additive supply part may supply the additive into the tub through an additive inlet provided in the first region of the inner wall of the tub.

The cup washer described herein may include a washing water supply part configured to supply water to the first region.

The additive storage part may include a first additive storage part and a second additive storage part.

The first additive storage part may store a first additive in a first storage space.

The second additive storage part may store a second additive in a second storage space.

The additive supply part may include a first additive supply part and a second additive supply part.

The first additive supply part may supply the first additive into the tub.

The second additive supply part may supply the second additive into the tub.

The cup washer described herein may include a controller configured to individually control the first additive supply part and the second additive supply part.

The first additive supply part may be configured to supply the first additive into the tub through a first additive inlet formed in the first region of the inner wall of the tub.

The second additive supply part may be configured to supply the second additive into the tub through the second additive inlet formed in the first region.

With the cup washer according to an embodiment of the present disclosure, the first additive supply pipe connects the lower portion of the additive storage part to the inlet of the additive pump so that the first supply passage through which the additive of the additive storage part moves toward the inlet of the additive pump can be provided. At this time, the first additive supply pipe and the inlet may be connected at a predetermined angle. Therefore, by placing the additive tube on one side of the additive supply pipe, the additive pump and the pump housing can be efficiently placed in the space below the additive storage part.

With the cup washer according to an embodiment of the present disclosure, the second additive supply pipe may be connected to the outlet of the additive pump. The second additive supply pipe may provide a second supply passage through which the additive discharged from the outlet of the additive pump located below the inlet moves to the outside of the pump housing. In this case, the second additive supply pipe and the outlet of the additive pump may be connected at a predetermined angle. Therefore, by placing the additive tube on one side of the additive supply pipe, the additive pump and the pump housing can be efficiently placed in the space below the additive storage part.

With the cup washer according to an embodiment of the present disclosure, the pump housing may accommodate the additive pump therein. The pump housing may be placed lower than the bottom of the storage space. Therefore, the additive pump can be placed lower than the bottom of the storage space. Therefore, the additive in the storage space can move to the additive pump by gravity.

With the cup washer according to an embodiment of the present disclosure, the power shaft configured to transmit the torque of the additive motor to the rotating roller may be provided between the heights of the inlet and the outlet. Therefore, the additive tube can be placed between the height of the inlet and outlet. In addition, the additive tube may be connected to the first additive supply pipe at approximately the shortest distance. Therefore, almost all of the additives in an inflow section can be moved to a pressing section by gravity without remaining in the inflow section. In addition, the additive tube may be connected to the second additive supply pipe at approximately the shortest distance. Therefore, almost all of the additives in a discharge section can be moved to the second supply passage by gravity without remaining in the discharge section.

With the cup washer according to an embodiment of the present disclosure, the first additive supply pipe and the second additive supply pipe may be configured as a single supply pipe, and the first supply passage and the second supply passage may be partitioned by the pipe wall. The pipe wall may be located between the heights of the inlet and outlet of the additive pump. In this case, the pipe wall may be placed at a height closer to the inlet than the outlet of the additive pump. Therefore, almost all of the additives introduced into the first supply passage from the storage space can move from the lower end portion of the first supply passage toward the inlet of the additive pump.

With the cup washer according to an embodiment of the present disclosure, a pair of sealing members may be interposed between the outer surface of the first additive supply pipe and the inner surface of the additive discharge hole. The pair of sealing members may be vertically spaced apart from each other within the additive discharge hole. The pair of sealing members may doubly prevent additive leakage through a space between the outer surface of the first additive supply pipe and the inner surface of the additive discharge hole. Therefore, leakage of the additive through the space between the outer surface of the first additive supply pipe and the inner surface of the additive discharge hole can be blocked.

With the cup washer according to an embodiment of the present disclosure, the pump housing may configure a first accommodation space and a second accommodation space therein. The first accommodation space may accommodate the additive pump. The second accommodation space may accommodate the additive motor. The first accommodation space and the second accommodation space may be partitioned by an intermediate partition. The first housing cover may be configured to open and close the first accommodation space. The second housing cover may be configured to open and close the second accommodation space. Therefore, the additive pump can be easily maintained and repaired by opening the first housing cover. In addition, the additive motor can be easily maintained and repaired by opening the second housing cover.

With the cup washer according to an embodiment of the present disclosure, close contact ribs, which are in close contact with the outer surface of the additive pump may be provided on the intermediate partition and the first housing cover. In the state in which the close contact ribs are in close contact with the outer surface of the additive pump in the first accommodation space, the close contact ribs may provide a movement boundary of the additive pump. Therefore, even when external force or vibration is transferred to the pump housing, the relative movement between the additive pump and the pump housing can be blocked. Therefore, the relative movement between the additive supply pipe and the additive pump can be blocked inside the pump housing.

With the cup washer according to an embodiment of the present disclosure, close contact ribs that are in close contact with the outer surface of the additive motor may be provided on the intermediate partition and the second housing cover. In the state in which the close contact ribs are in close contact with the outer surface of the additive motor in the second accommodation space, the close contact ribs may form a movement boundary of the additive motor. Therefore, even when external force or vibration is transferred to the pump housing, the relative movement between the additive motor and the pump housing may be blocked. Therefore, the relative movement between the additive motor inside the pump housing can be blocked.

With the cup washer according to an embodiment of the present disclosure, the first housing cover and the second housing cover may be coupled to the lower portion of the additive storage part from opposite sides with respect to the first additive supply pipe. Therefore, even when external force or vibration is transferred to the pump housing, the relative movement between the additive storage part and the pump housing can be blocked on the opposite sides with the first additive supply pipe interposed therebetween. Therefore, the state in which the first additive supply pipe is coupled to the additive storage part can be firmly maintained. Therefore, leakage of the additive through the space between the outer surface of the first additive supply pipe and the inner surface of the additive discharge hole can be blocked.

With the cup washer according to an embodiment of the present disclosure, the additive pump may include a magnetic force member and a magnetic force detector. The magnetic force detector may be configured to detector the magnetic force member on one side of the rotation path of the magnetic force member centered around the roller central shaft. Therefore, the controller may detect the rotation of the rotating roller with the magnetic force detector. Therefore, the controller can precisely control the amount of the additive supplied into the tub.

With the cup washer according to an embodiment of the present disclosure, the additive transfer pipe may connect the second additive supply pipe to the tub. The additive transfer pipe may be connected to the tub below the outlet. Therefore, the additive transfer pipe can supply the additive into the tub from below the outlet. Therefore, almost all of the additive discharged from the additive pump to the second supply passage can move into the tub by gravity.

According to the cup washer according to an embodiment of the present disclosure, the second additive transfer pipe may have a shorter length than the first additive transfer pipe. Therefore, even when the second additive is supplied in a smaller amount than the first additive, almost all of the second additive can move into the tub rather than remaining inside the second additive transfer pipe.

According to the cup washer according to an embodiment of the present disclosure, the first lower storage unit and the second lower storage unit may be manufactured in the same form. Therefore, when manufacturing the first additive storage part and the second additive storage part, the first lower storage unit and the second lower storage unit can be manufactured in the same mold. Therefore, the process of manufacturing the additive storage part can be simplified.

With the cup washer according to an embodiment of the present disclosure, the first additive supply part and the second additive supply part may be manufactured in the same form, except for the lengths of the additive transfer pipes. When manufacturing the cup washer, the first additive supply part and the second additive supply part may be manufactured in the same manufacturing process, and may be divided into the first additive supply part and a second additive supply part depending on an assembly location. Therefore, the manufacturing process of the additive supply part can be simplified.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EXEMPLARY EMBODIMENTS

Hereinafter, embodiments of the present disclosure will be described in detail with reference to the accompanying drawings. However, in the following description of the present disclosure, descriptions of already well-known functions or constructions will be omitted in order to make the gist of the present disclosure clear.

The X direction, Y direction, and Z direction to be described in embodiments of the present disclosure may be orthogonal to each other. Each of the X and Y directions may be parallel to the horizontal direction, and the Z direction may be parallel to the vertical direction. When the X direction is parallel to the left-right direction, the Y direction may be parallel to the front-rear direction. When the X direction is parallel to the front-rear direction, the Y direction may be parallel to the left-right direction.

Figure 1:
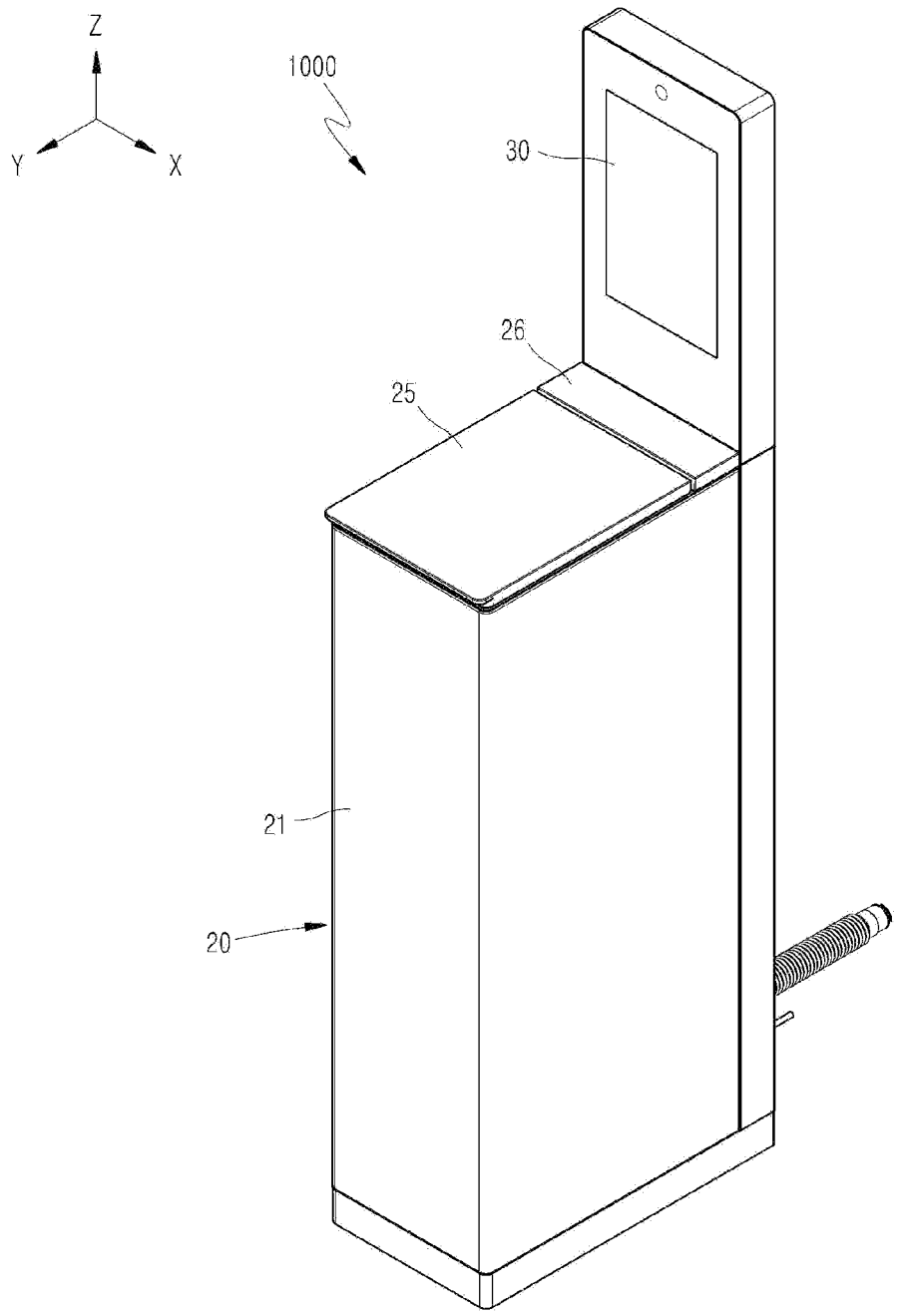
FIG. 1 is a perspective view of the cup washer according to an embodiment of the present disclosure viewed from a front upper side.

FIG. 1 is a perspective view of the cup washer 1000 according to an embodiment of the present disclosure viewed from a front upper side.

Figure 2:
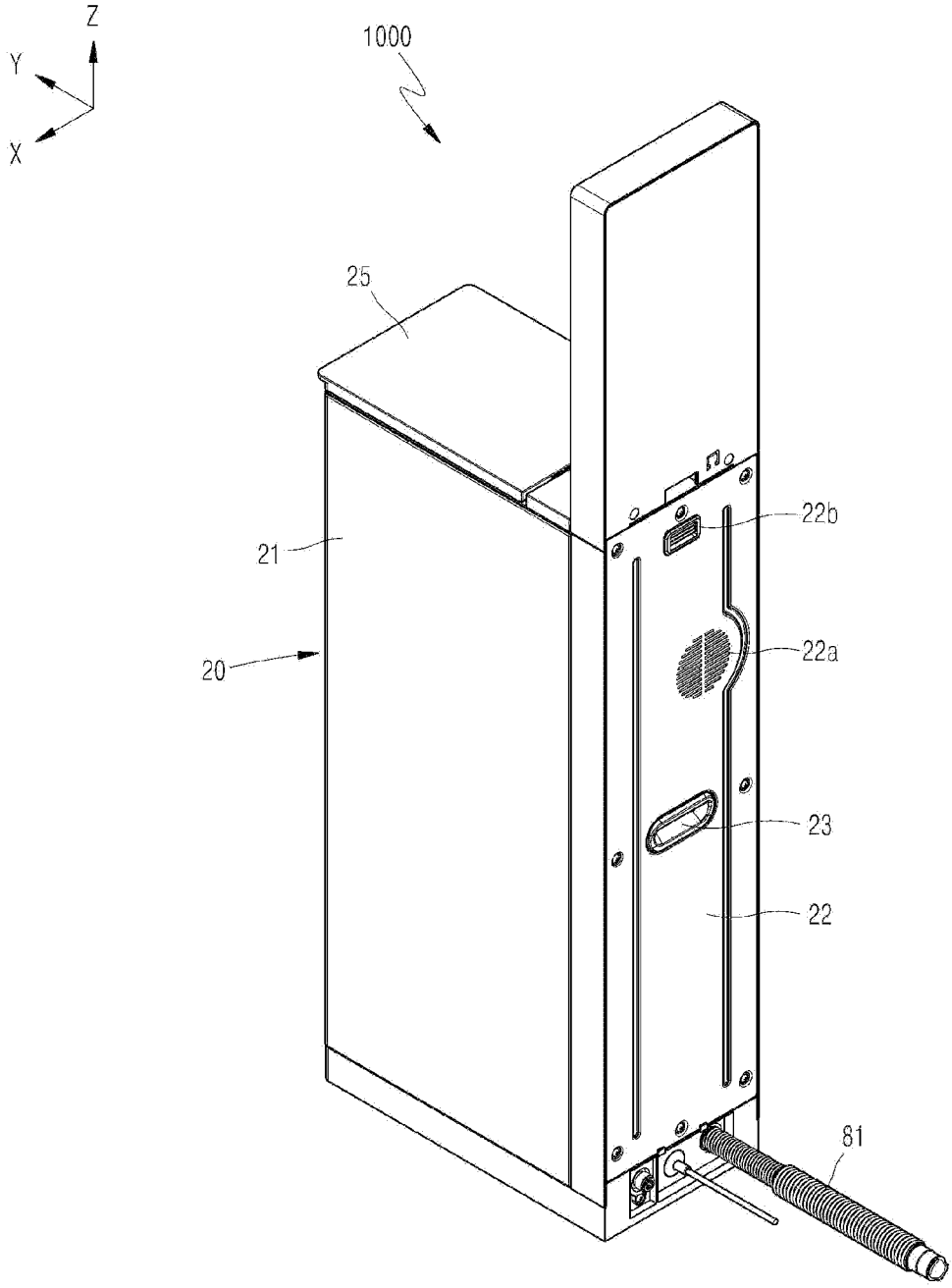
FIG. 2 is a perspective view of the cup washer of FIG. 1 viewed from a rear upper side.

FIG. 2 is a perspective view of the cup washer 1000 of FIG. 1 viewed from a rear upper side.

Figure 3:
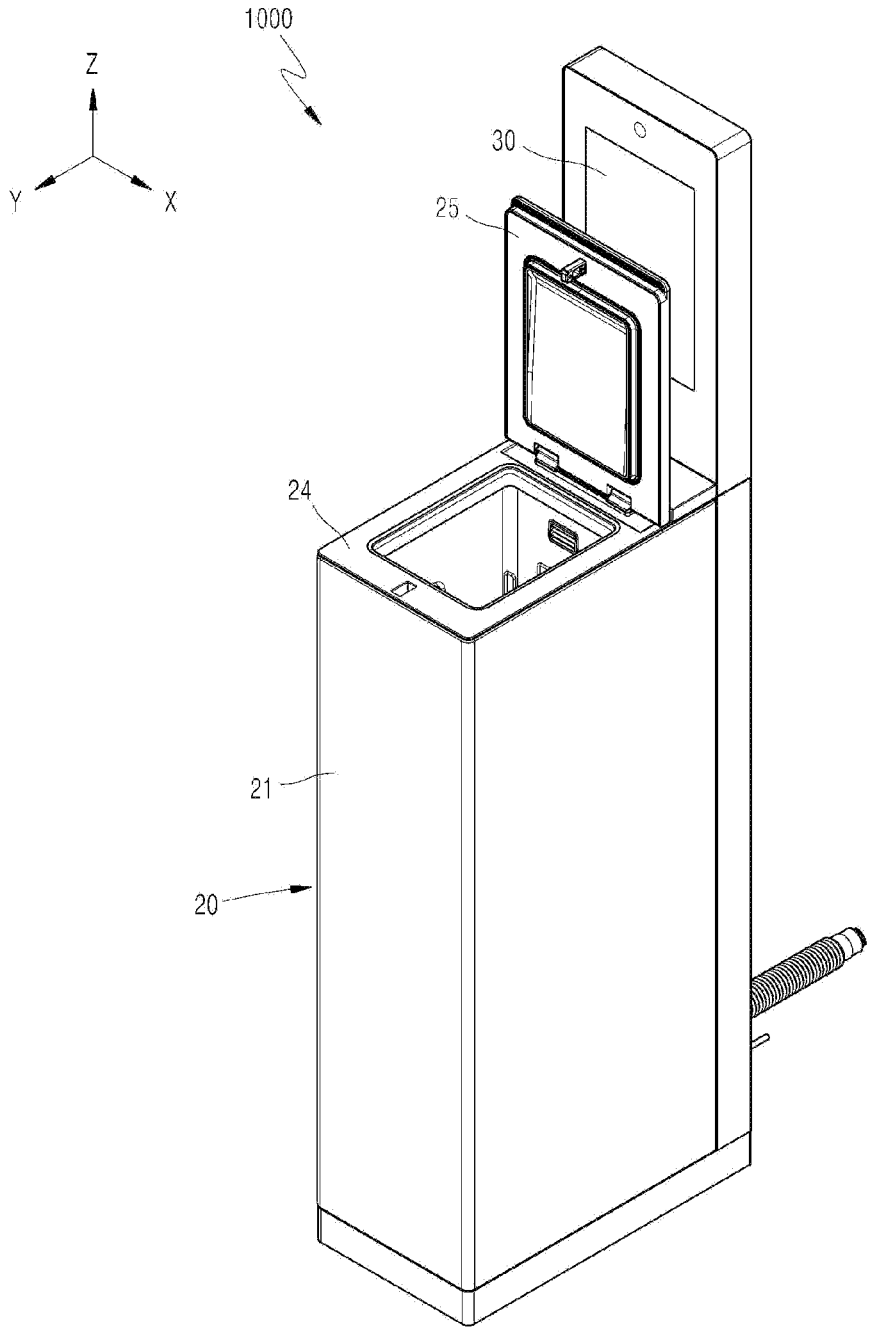
FIG. 3 is a perspective view of the cup washer of FIG. 1 in the state in which a front panel is removed.

FIG. 3 is a perspective view of the cup washer 1000 of FIG. 1 in the state in which a front panel 21 is removed.

Recently, as the awareness practicing carbon neutrality has expanded throughout society, the number of people carrying personal or reusable cups has increased. Accordingly, the number of government offices, companies, and stores where cup washers are installed for the hygiene and convenience of users (employees) is increasing. The cup washer 1000 according to an embodiment of the present disclosure may be installed in government offices, companies, or stores. The above-mentioned personal cup or reusable cup may mean a cup (made of a glass or plastic material), a mug, a tumbler, or the like.

The cup washer 1000 according to an embodiment of the present disclosure may have a tower shape that is long substantially in the vertical direction. Therefore, the floor area required for installation of the cup washer 1000 may be small compared to the total volume of the cup washer 1000.

The cup washer 1000 according to an embodiment of the present disclosure may include a frame 10, a panel 20, a display unit 30, a tub 100, a spray unit 300, a water reservoir 50, a sump 60, a circulation pump 70, a drain pump 80, an additive storage part 500, an additive supply part 600, a drying part 400, and a controller 40. The controller 40 may integrally control the display unit 30, the circulation pump 70, the drain pump 80, and the additive supply part 600.

The frame 10 may configure the framework of the cup washer 1000. The frame 10 may include a base frame 13, a front frame 11, a rear frame 12, and a horizontal frame 14.

The base frame 13 may configure the lowermost portion of the cup washer 1000. The base frame 13 may be seated on the ground. The front frame 11 and the rear frame 12 may define a shape extending upward from the edges of the base frame 13. The horizontal frame 14 may interconnect the front frame 11 and the rear frame 12 in the horizontal direction.

The panel 20 may be coupled to the frame 10 to isolate the components of the cup washer 1000 from the external environment. The panel 20 may include a front panel 21, a rear panel 22, a door 25, and a storage unit cover 26.

The front panel 21 may be coupled to the frame 10 to define the front surface and both side surfaces of the cup washer 1000 under the door 25. The rear panel 22 may be coupled to the frame 10 to define the rear surface of the cup washer 1000 below the display unit 30.

A vent 22*a* may be provided in the rear panel 22. Outside air may flow into the drying part 400 through the vent 22*a*. An air outlet 22*b* may be provided in the rear panel 22. Air from the drying part 400 may be discharged to the outside through the air outlet 22*b*. A handle 23 may be provided on the rear panel 22. A manager may easily move the cup washer 1000 by holding the handle 23.

The display unit 30 may be provided in the upper portion of the cup washer 1000. The screen of the display unit 30 may face the front side of the cup washer 1000. Therefore, the user of the cup washer 1000 may visually check the screen of the display unit 30 from the front side of the cup washer 1000. The display unit 30 may output the operating state of the cup washer 1000, such as "wash", "rinse", and "dry".

The display unit 30 may be configured with a touch panel. The user may input an operation command for the cup washer 1000 through the display unit 30.

The user may select a washing mode through the screen of the display unit 30. As an example, the user may select a "normal washing mode" or a "quick washing mode" through the screen of the display unit 30. The normal washing mode may refer to a mode in which a cup C is washed using a detergent and a conditioner. The quick washing mode may refer to a mode in which the cup C is washed only by spraying water without a detergent or a conditioner.

Figure 4:
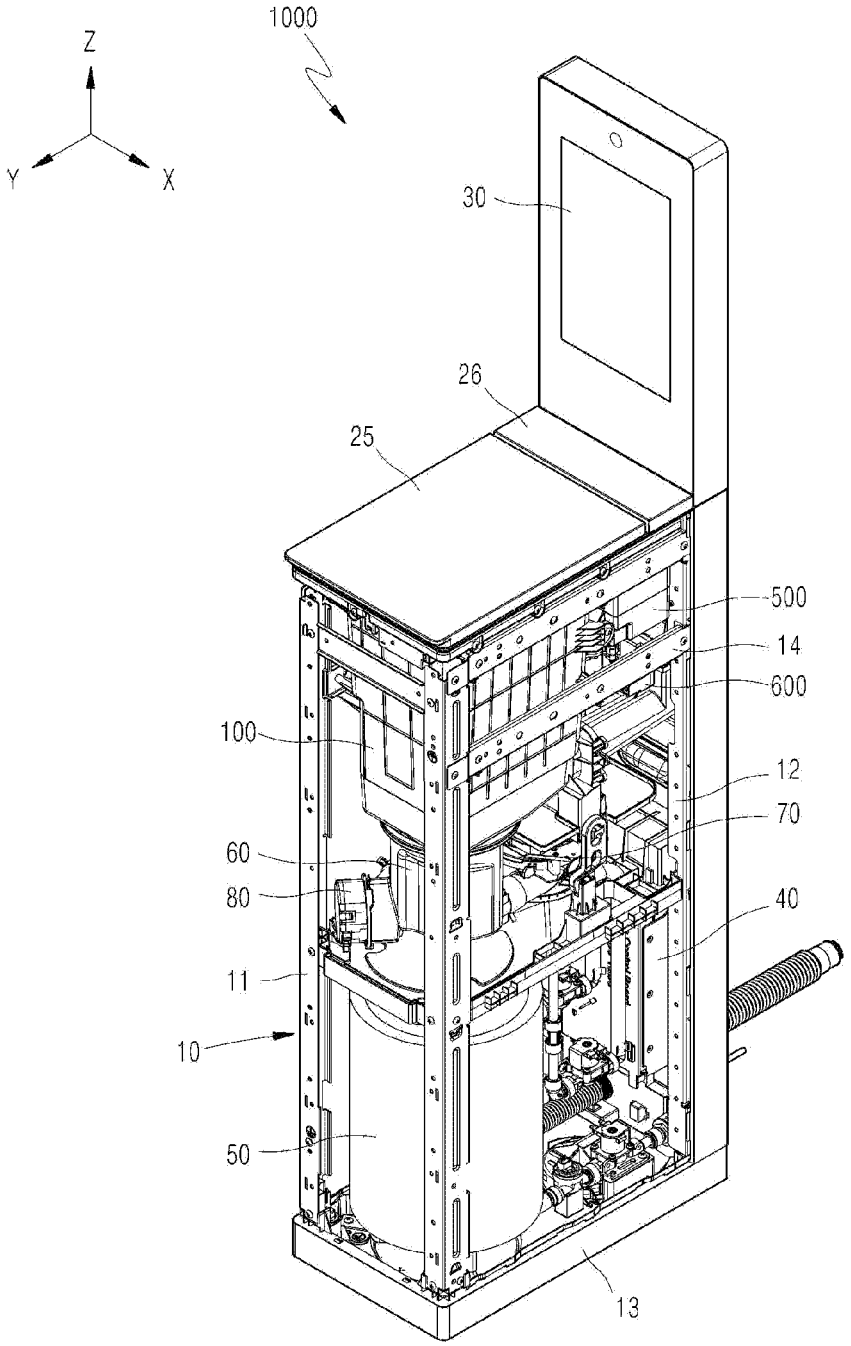
FIG. 4 is a partial perspective view of the cup washer of FIG. 1, illustrating the state in which a door is opened.

FIG. 4 is a partial perspective view of the cup washer 1000 of FIG. 1, illustrating the state in which a door 25 is opened.

Figure 5:
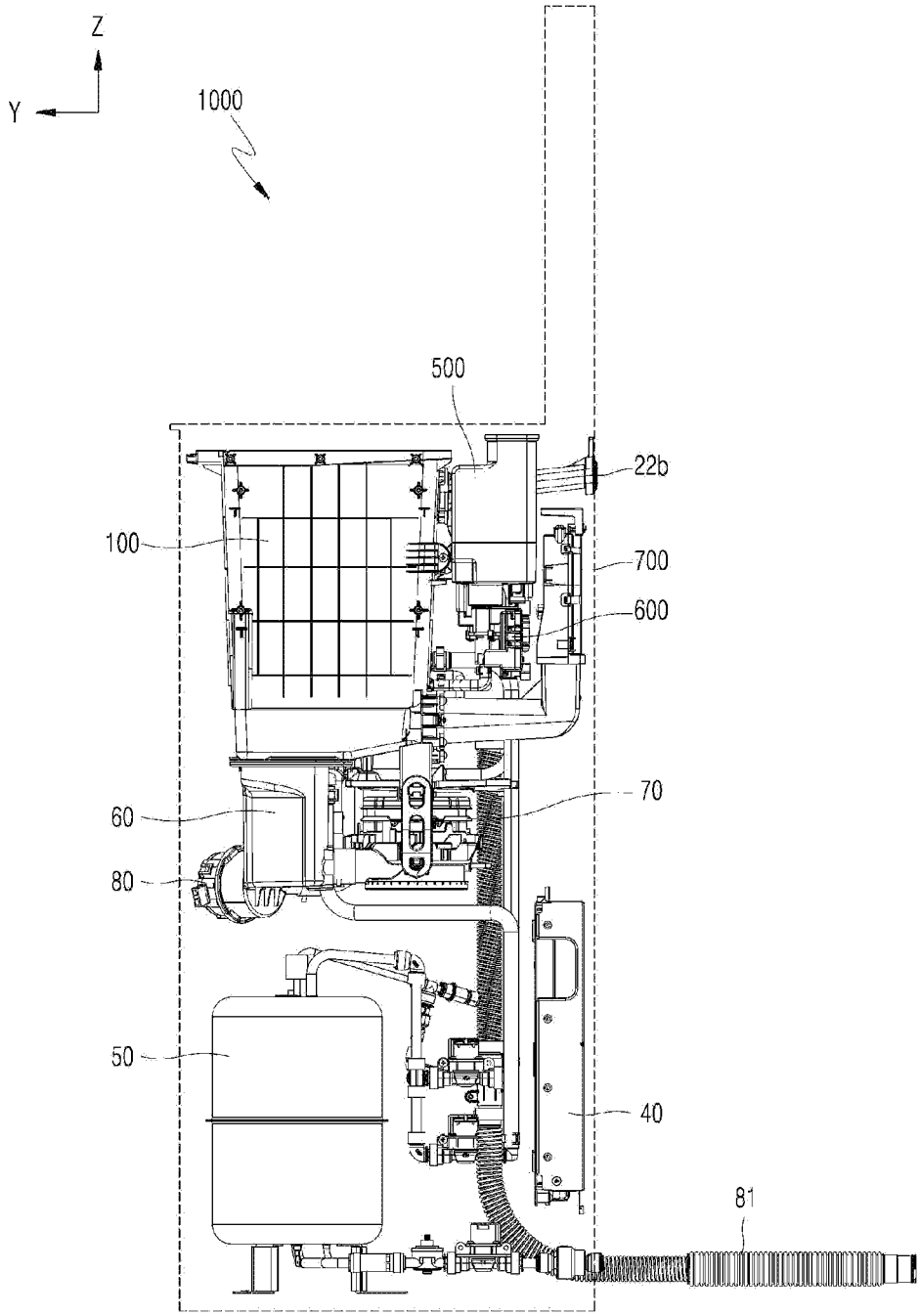
FIG. 5 is a side view of the cup washer of FIG. 1 in which a frame, a panel, a door, and a display unit are not illustrated.

FIG. 5 is a side view of the cup washer 1000 of FIG. 1, in which the frame 10, the panel 20, the door 25, and the display unit 30 are not illustrated.

The panel 20 may include a top panel 24. The top panel 24 may be coupled to the upper end portion of the front panel 21. The top panel 24 may isolate the components inside the front panel 21 from the external environment at the upper end portion of the front panel 21, except for an upper opening of the tub 100 and an upper opening of the additive storage part 500. The storage unit cover 26 may open or close the upper opening of the additive storage part 500.

The door 25 may open or close the top opening of the tub 100. The door 25 may be rotatably coupled to the top panel 24. When the door 25 is closed (see FIG. 1), the door 25 may protrude forward from the front panel 21. When the door 25 is closed, the user may easily rotate (open) the door 25 by lifting the forward protruding portion upward.

Figure 6:
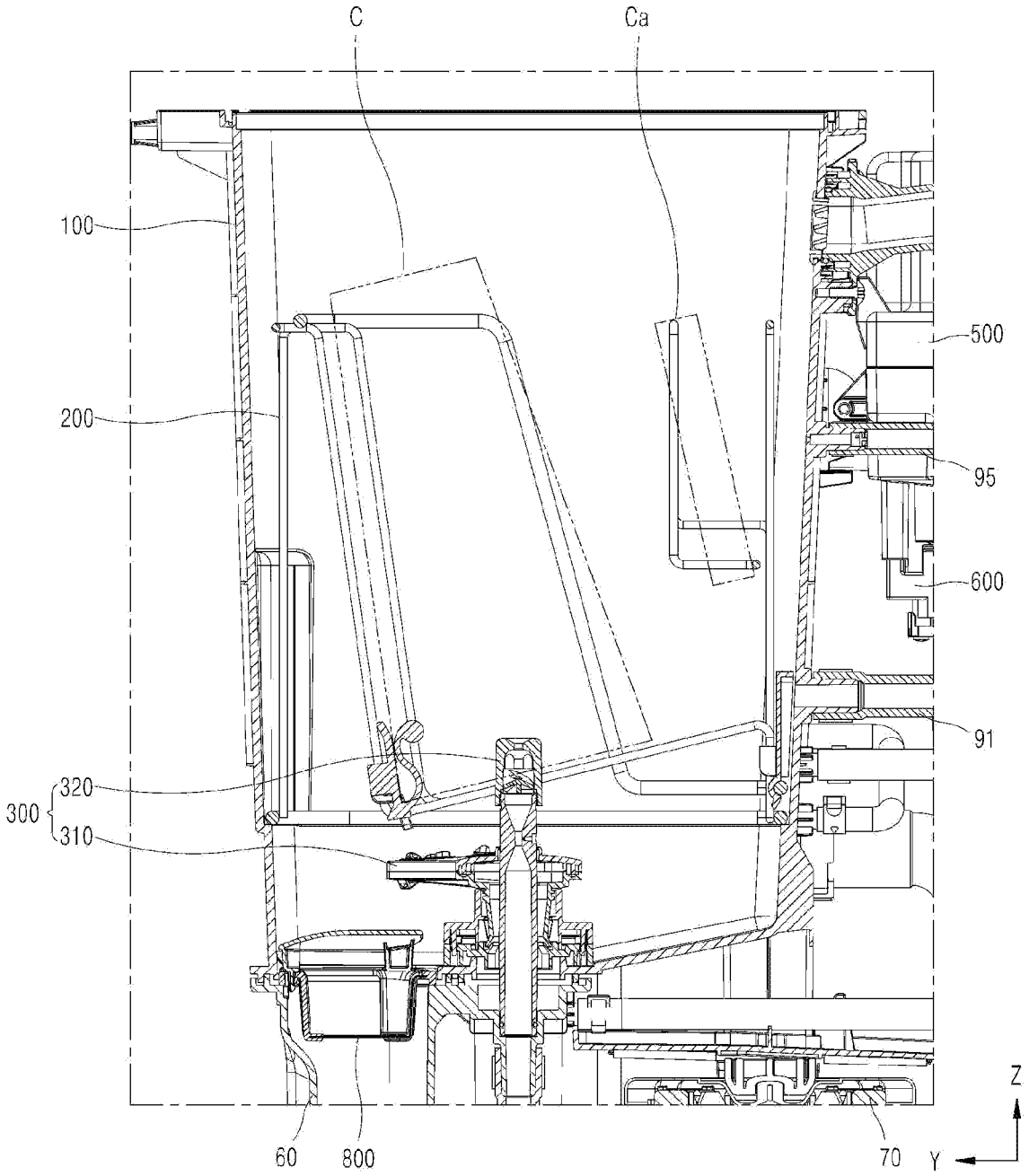
FIG. 6 is a partial cross-sectional view of the cup washer of FIG. 5 in which a cup and a cup lid mounted on a rack are illustrated with imaginary lines.

FIG. 6 is a partial cross-sectional view of the cup washer 1000 of FIG. 5, illustrating a cup C and a cup lid Ca mounted on the rack 200 with imaginary lines.

The tub 100 may provide therein a space (hereinafter, referred to as a "washing space") in which the cup C is washed. The tub 100 may be in the form of a hollow three-dimensional object with an opening (hereinafter, referred to as a "cup inlet") at approximately the upper end thereof. The door 25 can open or close the cup inlet. The user may put the cup C into the washing space or take out the cup C from the washing space through the cup inlet.

A rack 200 on which the cup C and the cup lid Ca are mounted may be provided in the washing space. The rack 200 may be put into or taken out from the washing space through the cup inlet. The cup C and the cup lid Ca may be spaced apart from the inner surface of the tub 100 while being mounted on the rack 200. The cup C may be placed on the rack 200 with its top and bottom turned upside down.

The cup washer 1000 according to an embodiment of the present disclosure may include a spray unit 300. The spray unit 300 may be installed in the lower portion of the tub 100. When the cup C is mounted on the rack 200, the upper opening of the cup C may be located above the spray unit 300. The spray unit 300 is able to spray water toward the inside and outside of the cup C in the washing space. The spray unit 300 may include a first spray nozzle 310 and a second spray nozzle 320.

Figure 7:
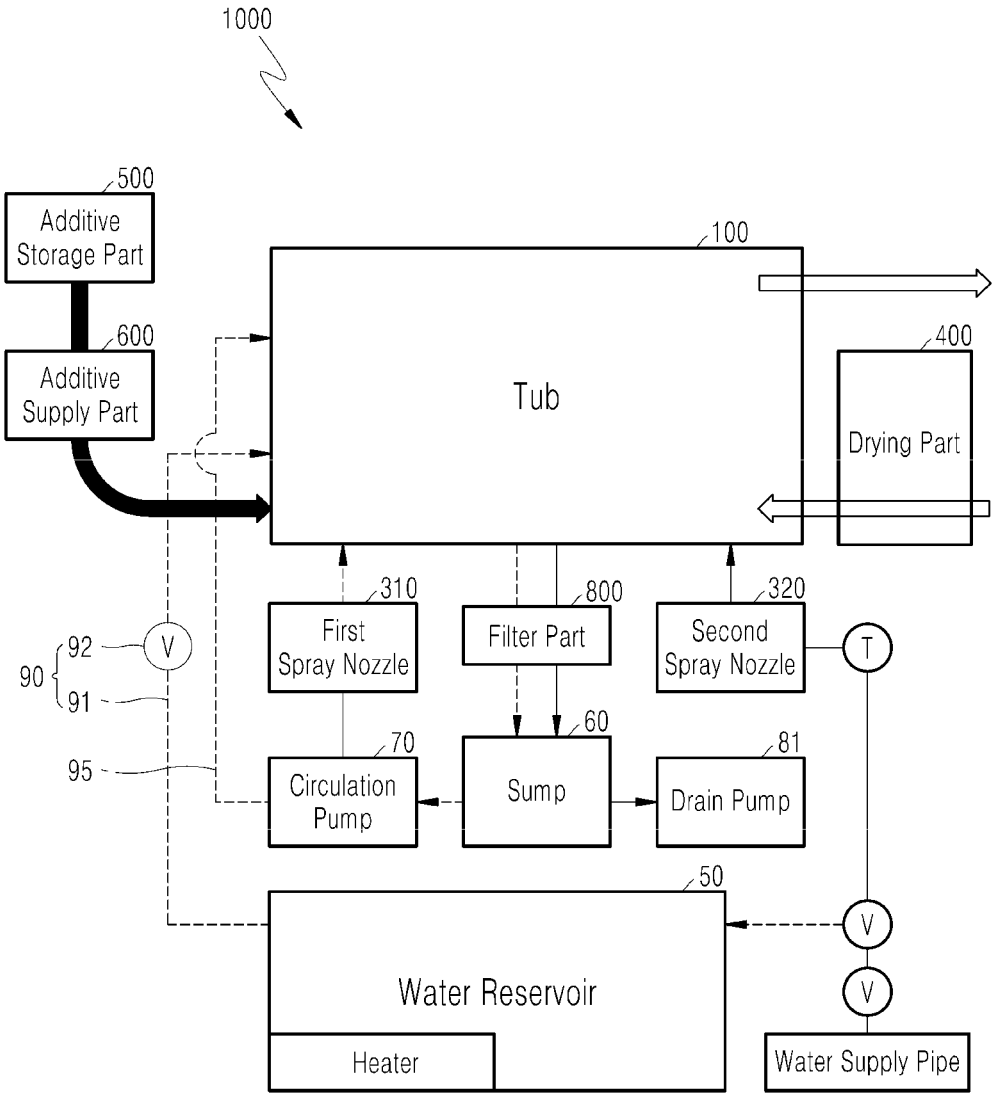
FIG. 7 is a schematic view of a cup washer according to an embodiment of the present disclosure.

FIG. 7 is a schematic view of the cup washer 1000 according to an embodiment of the present disclosure. FIG. 7 is a schematic view illustrating the movement paths of water, additive, and air, and the relative arrangement of components may differ from reality.

In FIG. 7, the dotted line arrows may indicate the path of water sprayed by the first spray nozzle 310. In addition, the solid arrows may indicate the path of water sprayed by the second spray nozzle 320. In addition, the thick black arrow may indicate the movement path of the additive. In addition, the thick white arrows may refer to air movement paths.

The water reservoir 50 is able to store water. The water reservoir 50 may be heavier than other components. The water reservoir 50 may be coupled to the top surface of the base frame 13. Therefore, the overall center of gravity of the cup washer 1000 may be lowered. Therefore, even when the cup washer 1000 is configured in a tower shape that is long substantially in the vertical direction, the possibility of the cup washer 1000 falling over may be reduced.

The water reservoir 50 may be connected to a water supply pipe. Water from the water supply pipe may be supplied to the water reservoir 50. A water level sensor may be installed in the water reservoir 50. An opening/closing valve may be provided between the water supply pipe and the water reservoir 50. The controller 40 can control the opening/closing valve by receiving a signal from the water level sensor.

A heater and a temperature sensor may be provided in the water reservoir 50. The heater may heat the water in the water reservoir 50. The controller 40 may control the heater by receiving a signal from the temperature sensor.

The water in the water reservoir 50 may be supplied into the tub 100 through the washing water supply part 90. The washing water supply part 90 may include a washing water supply pipe 91 and an opening/closing valve 92. The controller 40 may control the opening/closing valve 92.

The additive storage part 500 may store an additive therein. The additive supply part 600 may supply the additive stored in the additive storage part 500 into the tub 100.

As described above, the user may select a washing mode through the screen of the display unit 30. As an example, the user may select a "normal washing mode" or a "quick washing mode" through the screen of the display unit 30.

The normal washing mode may refer to a mode in which a cup C is washed using a detergent and a conditioner. The quick washing mode may refer to a mode in which a cup C is washed only by spraying water without a detergent or a conditioner.

The normal washing mode may include a normal washing step and a drying step. When the user selects the "normal washing mode" through the screen of the display unit 30, the water in the water reservoir 50 may be supplied into the tub 100 through the washing water supply part 90. The washing water supply part 90 may include a washing water supply pipe 91 and an opening/closing valve. In this case, the additive supply part 600 may supply the additive into the tub 100 for a set period of time. The additive may be mixed with water within the tub 100.

The water mixed with the additive may flow into the sump 60 on the lower side of the tub 100 through the filter part 800 by gravity. The circulation pump 70 may press the water flowing into the sump 60 toward the first spray nozzle 310.

The first spray nozzle 310 may spray the water mixed with the additive toward the inside and outside of the cup C. In addition, the circulation pump 70 may supply water flowing into the sump 60 into the tub 100 through the washing water spray unit 95. The washing water spray unit 95 may spray the water mixed with the additive toward the cup lid Ca.

The circulation pump 70 may operate for a set period of time. When the set period of time elapses, the water flowing into the sump 60 may move to a drain pipe 81 through the drain pump 80 and may be drained out of the cup washer 1000 (completing of the normal washing step).

The additive may include a first additive and a second additive. The first additive may be provided as a detergent. The second additive may be provided as a conditioner. In this case, the normal washing step may include a first normal washing step and a second normal washing step.

The first normal washing step may be the step of washing the cup C with the water mixed with the first additive. The second normal washing step may be the step of washing the cup C with the water mixed with the second additive. The first normal washing step and the second normal washing step may be performed sequentially.

Once the normal washing step is completed, the drying step may be performed. The drying part 400 may supply heated air into the tub 100. During this process, moist air within the tub 100 may be discharged to the outside. The drying step may be performed for a set period of time (completing of the drying step).

The second spray nozzle 320 may be connected to the water supply pipe. A three-way valve may be installed between the water supply pipe and the water reservoir 50. The second spray nozzle 320 may be connected to the water supply pipe through the three-way valve. An opening/closing valve may be provided between the second spray nozzle 320 and the three-way valve. The controller 40 may control the three-way valve and the open/close valve.

The quick washing mode may include a quick washing step and a drying step. When the user selects the "quick washing mode" through the screen of the display unit 30, the second spray nozzle 320 may be connected to the water supply pipe through the three-way valve. In the quick washing mode, the additive may not be supplied into the tub 100.

The second spray nozzle 320 may spray water not mixed with the additive into the cup C. The opening/closing valve may open the flow path between the water supply pipe and the second spray nozzle 320 for a set period of time. When the set period of time elapses, the water flowing into the sump 60 may move to a drain pipe 81 through the drain pump 80 and may be drained out of the cup washer 1000 (completing of the quick washing step).

Once the quick washing step is completed, the drying step may be performed. The drying part 400 may supply heated air into the tub 100. During this process, moist air within the tub 100 may be discharged to the outside. The drying step may be performed for a set period of time (completing of the drying step).

Figure 8:
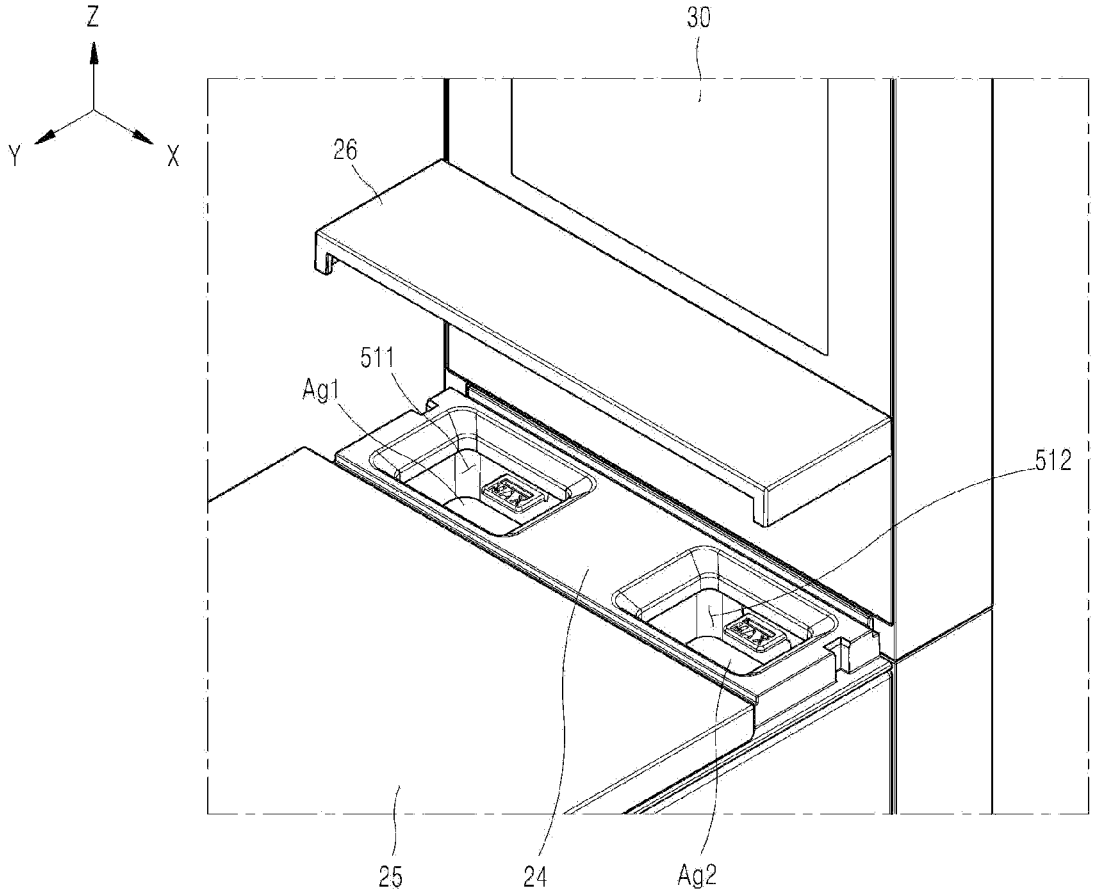
FIG. 8 is a partial perspective view of the cup washer of FIG. 1, illustrating the state in which a storage unit cover is opened.

FIG. 8 is a partial perspective view of the cup washer 1000 of FIG. 1, illustrating the state in which the storage unit cover 26 is opened.

Figure 9:
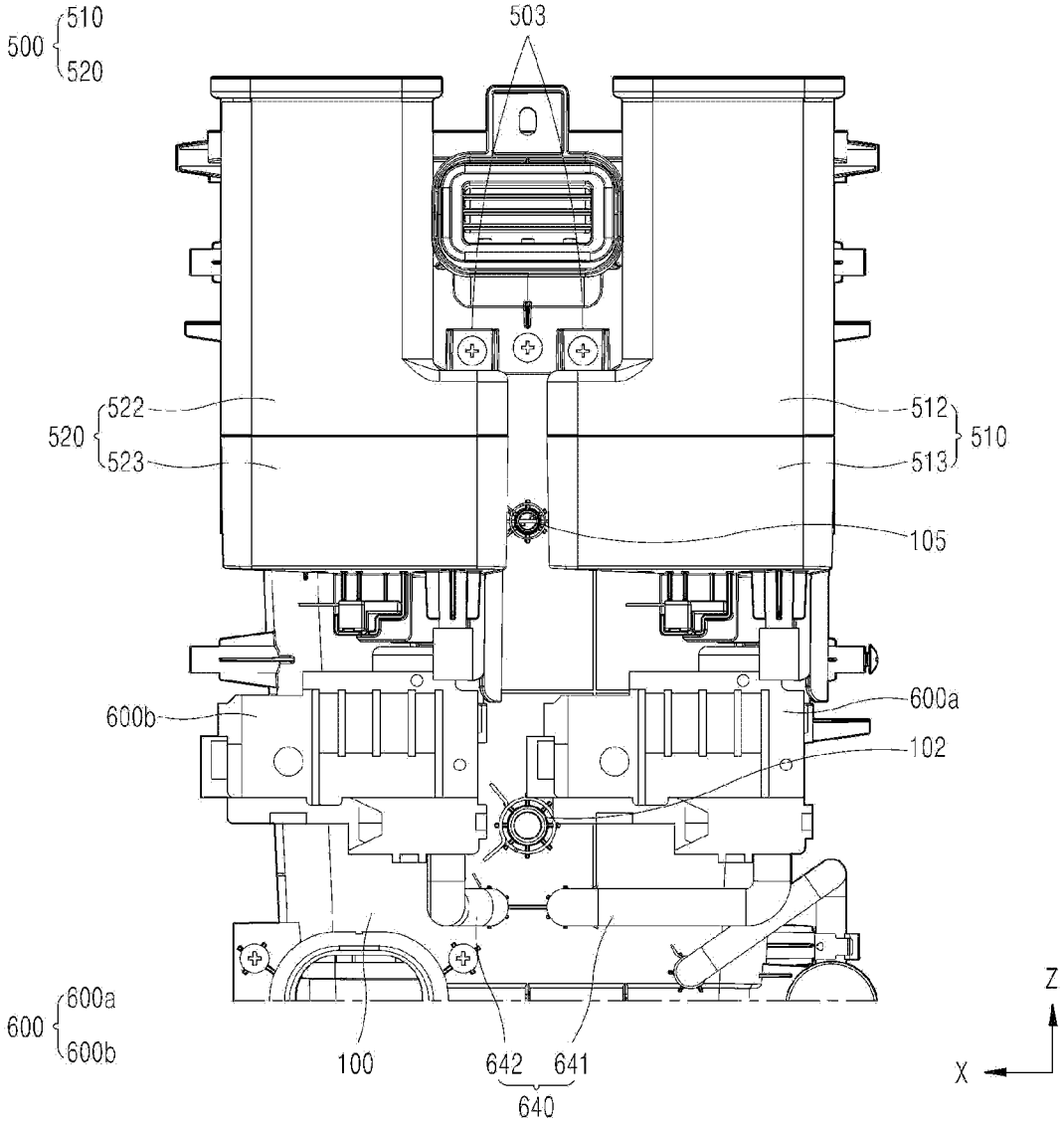
FIG. 9 is a partial rear view of the cup washer of FIG. 5, illustrating a tub, an additive storage part, and an additive supply part.

FIG. 9 is a partial rear view of the cup washer 1000 of FIG. 5, illustrating the tub 100, the additive storage part 500, and the additive supply part 600.

Figure 10:
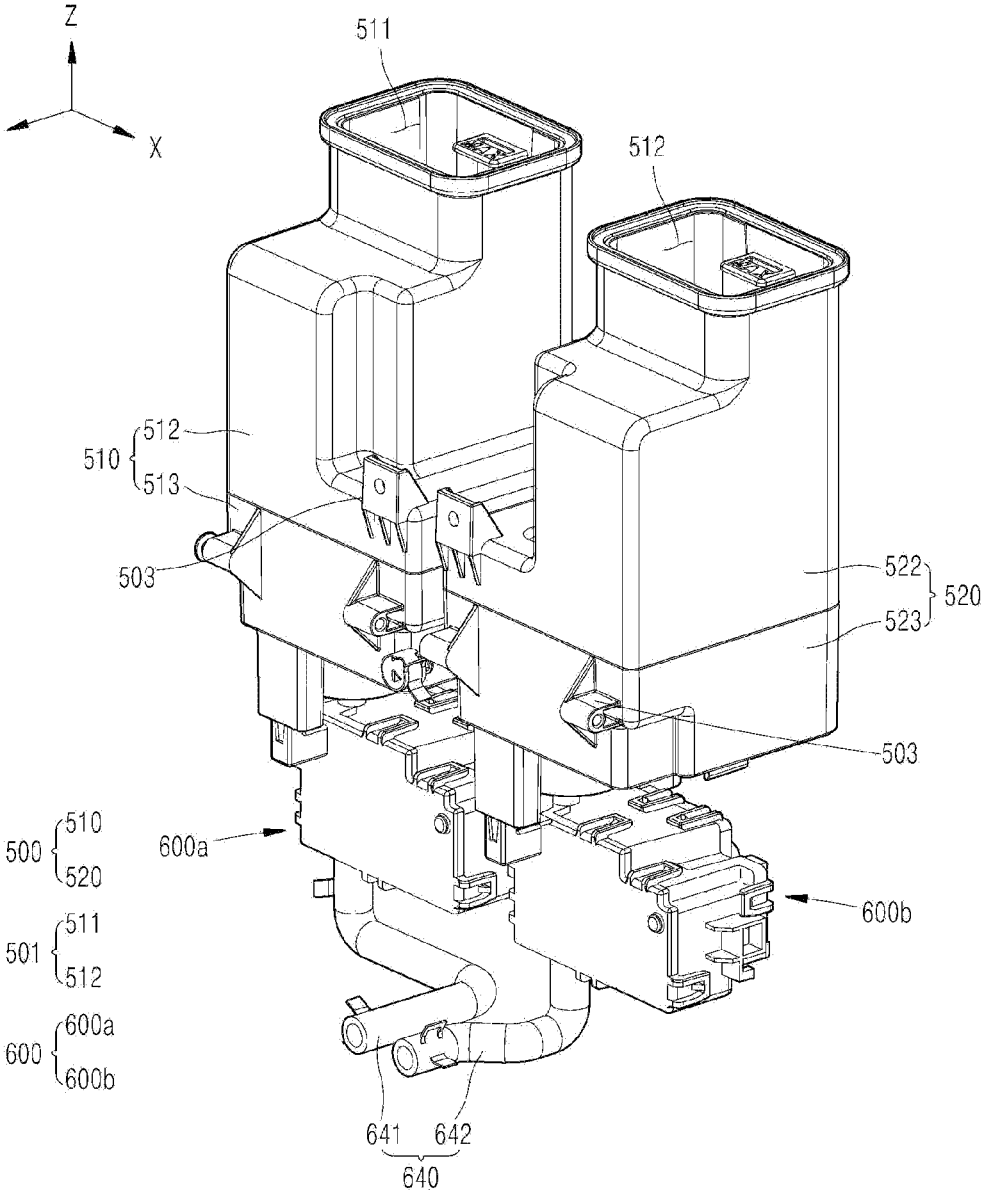
FIG. 10 is a perspective view illustrating the additive storage part and the additive supply part of FIG. 9.

FIG. 10 is a perspective view illustrating the additive storage part 500 and the additive supply part 600 of FIG. 9.

The additive storage part 500 may be provided behind the tub 100. The additive storage part 500 may be coupled to the tub 100 by a coupling member such as a bolt. Bolt coupling portions 503 where coupling members are coupled to the additive storage part 500 and the tub 100 may be formed.

The additive storage part 500 may store an additive Ag in an inner portion thereof (hereinafter, referred to as a "storage space 501"). The additive Ag may include a first additive Ag1 and a second additive Ag2. The first additive Ag1 may be provided as a detergent. The second additive Ag2 may be provided as a conditioner. The additive storage part 500 may include a first additive storage part 510 and a second additive storage part 520.

The first additive storage part 510 may store the first additive Ag1 inside an inner portion thereof (hereinafter, referred to as a "first storage space 511"). The first additive storage part 510 may have an opening (hereinafter. referred to as "first additive inlet") at the upper end thereof. The user may fill the first additive Ag1 into the first storage space 511 through the first additive inlet. An additive discharge hole 502 may be provided in the lower portion of the first additive storage part 510.

The second additive storage part 520 may store the second additive Ag2 in the inner portion thereof (hereinafter, referred to as a "second storage space 521"). The second additive storage part 520 may have an opening (hereinafter, referred to as a "second additive inlet") at the upper end thereof. The user may fill the second additive Ag2 into the second storage space 521 through the second additive inlet. An additive discharge hole 502 may be provided in the lower portion of the second additive storage part 520.

The storage unit cover 26 may simultaneously open or close the first additive inlet and the second additive inlet. The top panel 24 may isolate the components inside the front panel 21 from the external environment at the upper end portion of the front panel 21, except for the cup inlet and the additive inlets. The edge portion (hereinafter, referred to as a "cover edge portion") of the storage unit cover 26 may be bent downward. In the state in which the cover edge portion seated on the top panel 24, the storage unit cover 26 may simultaneously close the first additive inlet and the second additive inlet.

The first additive storage part 510 may include a first upper storage unit 512 and a first lower storage unit 513. The first upper storage unit 512 may define the upper portion of the first storage space 511. The first lower storage unit 513 may define the lower portion of the first storage space 511. The lower end portion of the first upper storage unit 512 and the upper end portion of the first lower storage unit 513 may be bonded to each other by adhesive, heat fusion, or the like.

A floater and a floater sensor may be installed in the first storage space 511. The floater may be floated by the first additive Ag1. The floater sensor may detect the height of the floater. The controller 40 may receive a signal from the floater sensor. The controller 40 may output the amount of the first additive Ag1 on the screen of the display unit 30.

The second additive storage part 520 may include a second upper storage unit 522 and a second lower storage unit 523. The second upper storage unit 522 may define the upper portion of the second storage space 521. The second lower storage unit 523 may define the lower portion of the second storage space 521. The lower end portion of the second upper storage unit 522 and the upper end portion of the second lower storage unit 523 may be bonded to each other by adhesive, heat fusion, or the like.

A floater and a floater sensor may be installed in the second storage space 521. The floater may be floated by the second additive Ag2. The floater sensor may detect the height of the floater. The controller 40 may receive a signal from the floater sensor. The controller 40 may output the amount of the second additive Ag2 on the screen of the display unit 30.

The arrow on the X-axis may point to the right based on the user's field of view in front of the cup washer 1000. The arrow on the Y axis may point to the front. The arrow on the Z axis can point to the top. With respect to the X-axis direction, the first additive storage part 510 may be located on one side, and the second additive storage part 520 may be located on the other side. In an embodiment of the present disclosure, the first additive storage part 510 may be located on the left from the rear of the tub 100, and the second additive storage part 520 may be located on the right from the rear of the tub 100.

The first upper storage unit 512 and the second upper storage unit 522 may be symmetrical with respect to the virtual YZ plane. Therefore, with respect to the X-axis direction, the first additive inlet and the second additive inlet may be spaced apart from each other (see FIG. 8).

Therefore, even if the first additive Ag1 falls or overflows between the first additive inlet and the second additive inlet due to the user's carelessness or the tilt of the cup washer 1000, the first additive Ag1 may be prevented from flowing into the second storage space 521.

The first lower storage unit 513 and the second lower storage unit 523 may be manufactured in the same form. Therefore, when manufacturing the first additive storage part 510 and the second additive storage part 520, the first lower storage unit 513 and the second lower storage unit 523 may be manufactured in the same mold. Therefore, the process of manufacturing the additive storage part 500 can be simplified.

The additive supply part 600 may be provided below the additive storage part 500 behind the tub 100. The additive supply part 600 may be coupled to the additive storage part 500 by a coupling member and hook coupling.

The additive supply part 600 may supply the additive Ag from the storage space 501 into the tub 100. As described above, the additive Ag may include a first additive Ag1 and a second additive Ag2. The first additive Ag1 may be provided as a detergent. The second additive Ag2 may be provided as a conditioner. The additive supply part 600 may include a first additive supply part 600*a* and a second additive supply part 600*b*.

The first additive supply part 600*a* may be provided below the first additive storage part 510 behind the tub 100. The first additive supply part 600*a* may supply the first additive Ag1 from the first storage space 511 into the tub 100.

The second additive supply part 600*b* may be provided below the second additive storage part 520 behind the tub 100. The second additive supply part 600*b* may supply the second additive Ag2 from the second storage space 521 into the tub 100.

As described above, the additive Ag may include a first additive Ag1 and a second additive Ag2. In this case, the normal washing step may include a first normal washing step and a second normal washing step. The first normal washing step may be the step of washing the cup C with the water mixed with the first additive Ag1. The second normal washing step may be the step of washing the cup C with the water mixed with the second additive Ag2.

The controller 40 may individually control the first additive supply part 600*a* and the second additive supply part 600*b*. Accordingly, the controller 40 may sequentially perform the first normal washing step and the second normal washing step. That is, after completing the washing of the cup C using the first additive Ag1 (first normal washing step), the controller 40 may perform the washing of the cup C using the second additive Ag2 (second normal washing step).

The first additive supply part 600*a* and the second additive supply part 600*b* may be manufactured in the same form, except for the lengths of the additive transfer pipes 640. When manufacturing the cup washer 1000, the first additive supply part 600*a* and the second additive supply part 600*b* may be manufactured in the same manufacturing process, and the first additive supply part 600*a* and the second additive supply part 600*b* may be separated depending on the assembly locations thereof. Therefore, the manufacturing process of the additive supply part 600 can be simplified.

Since the first additive supply part 600*a* and the second additive supply part 600*b* are manufactured in the same form, the detailed configurations of the first additive supply part 600*a* and the second additive supply part 600*b* will be described simultaneously below. Hereinafter, the additive supply part 600 should be understood to mean the first additive supply part 600*a* and the second additive supply part 600*b*.

Figure 11:
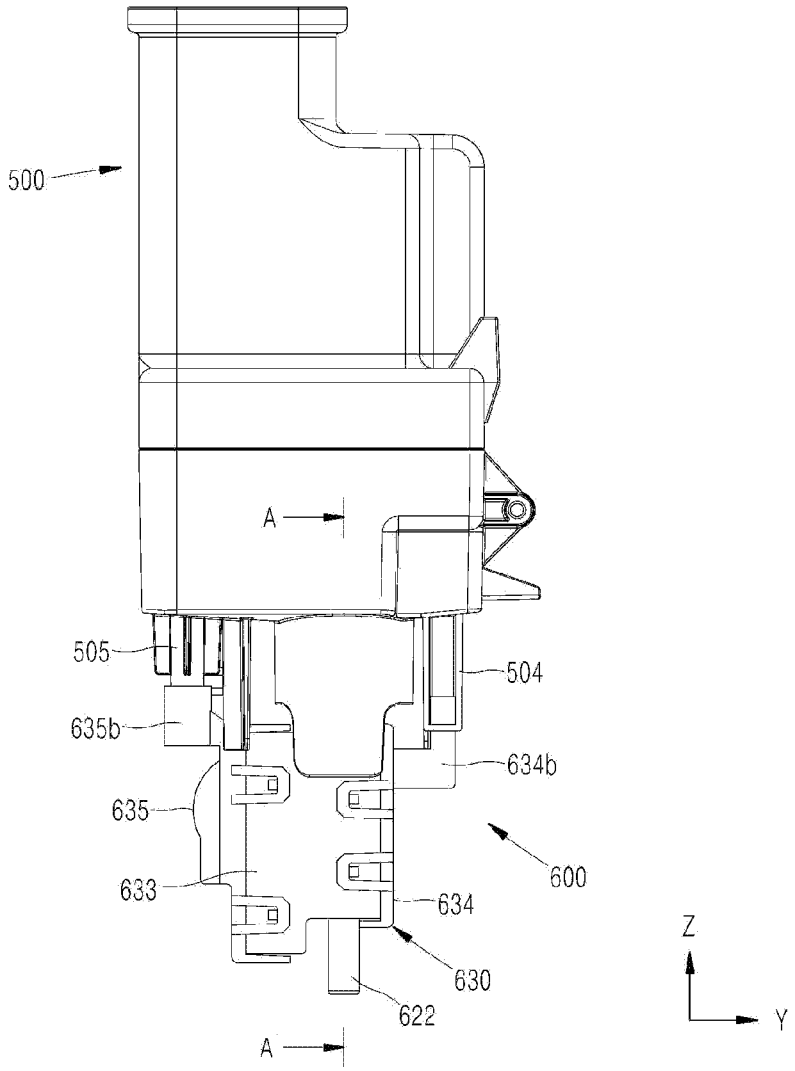
FIG. 11 is a side view illustrating the additive storage part and the additive supply part of FIG. 10.

FIG. 11 is a side view illustrating the additive storage part 500 and the additive supply part 600 of FIG. 10.

Figure 12:
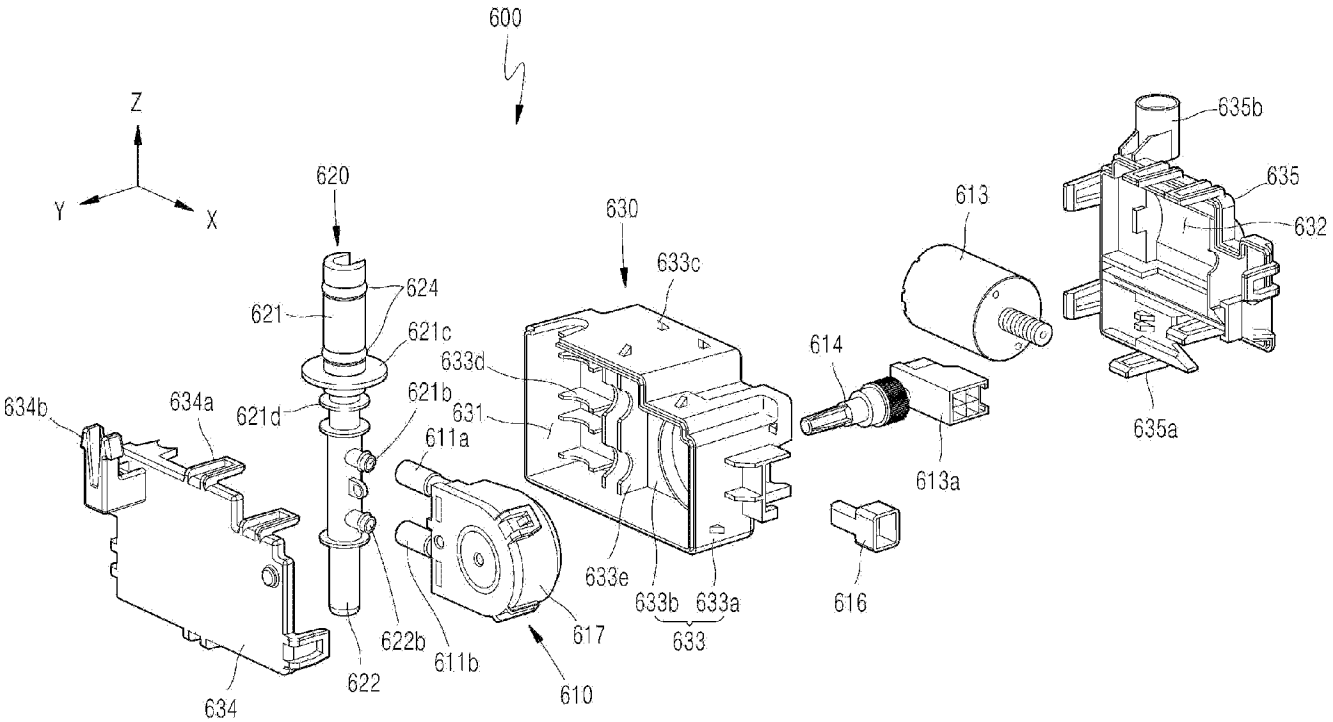
FIG. 12 is an exploded perspective view of the additive supply part of FIG. 10.

FIG. 12 is an exploded perspective view of the additive supply part 60 of FIG. 10.

Figure 13:
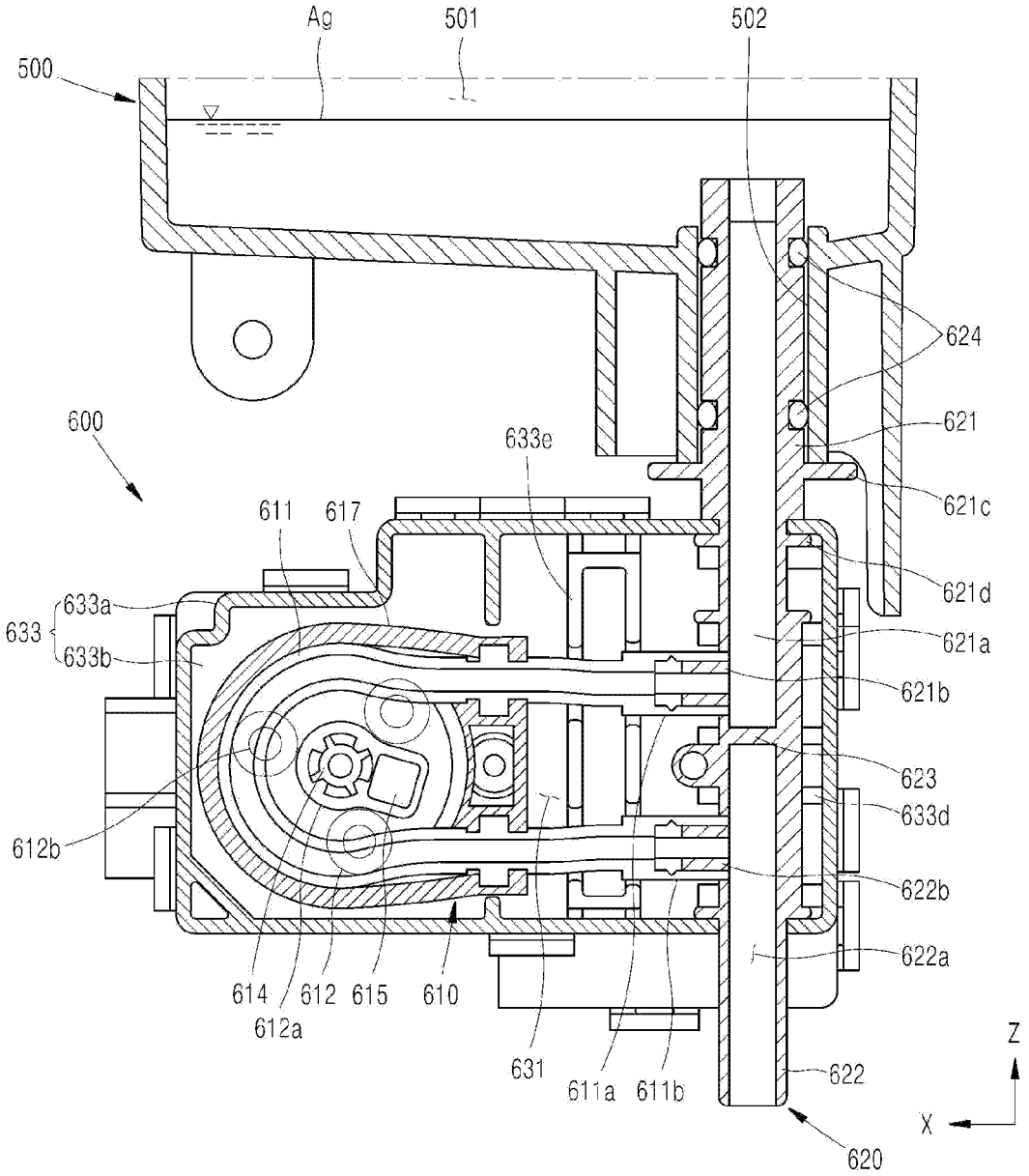
FIG. 13 is a cross-sectional view taken along line A-A' in FIG. 11.

FIG. 13 is a cross-sectional view taken along line A-A' in FIG. 11.

The additive supply part 600 may include an additive pump 610, an additive supply pipe 620, a pump housing 630, and an additive transfer pipe 640.

The additive supply pipe 620 may include a first additive supply pipe 621 and a second additive supply pipe 622. The first additive supply pipe 621 and the second additive supply pipe 622 may be configured as a single supply pipe. That is, the first additive supply pipe 621 and the second additive supply pipe 622 may be manufactured as one piece, and thus the additive supply pipe 620 may have a longitudinally long pipe shape in appearance.

The first additive supply pipe 621 may form the upper portion of the additive supply pipe 620. The first additive supply pipe 621 may take a form of a circular hollow tube that is long substantially in the vertical direction.

The first additive supply pipe 621 may connect the lower portion of the additive storage part 500 to the inlet 611*a* of the additive pump 610. The first additive supply pipe 621 may provide a passage (hereinafter, referred to as a "first supply passage 621*a*") through which the additive Ag of the additive storage part 500 moves toward the inlet 611*a* of the additive pump 610. The first supply passage 621*a* may have a long shape substantially in the vertical direction. An inlet insertion portion 621*b* that is inserted into the inlet 611*a* of the additive pump 610 may be provided in the lower portion of the first additive supply pipe 621.

An additive discharge hole 502 into which the first additive supply pipe 621 is inserted in the vertical direction may be provided in the lower portion of the additive storage part 500. The inner surface of the additive discharge hole 502 may have a long cylindrical shape in the vertical direction. The first additive supply pipe 621 may be inserted into the additive discharge hole 502 by moving upward from the bottom of the additive storage part 500. Therefore, the first additive supply pipe 621 may be coupled to the additive storage part 500.

A first supply pipe flange 621*c* may be provided on the outer surface of the first additive supply pipe 621. The first supply pipe flange 621*c* may protrude in the radial direction along the circumferential direction from the outer surface of the first additive supply pipe 621. When the first additive supply pipe 621 is inserted into the additive discharge hole 502, the top surface of the first supply pipe flange 621*c* may be caught the lower end of the additive discharge hole 502. Therefore, the first additive supply pipe 621 may be inserted into the additive discharge hole 502 at a predetermined depth (height).

In the storage space 501, the bottom of the additive storage part 500 may slope downward toward the additive discharge hole 502. Therefore, almost all of the additive Ag filled in the storage space 501 may move toward the additive discharge hole 502 by gravity.

In the state in which the top surface of the first supply pipe flange 621*c* is caught at the lower end of the additive discharge hole 502, the upper end of the first additive supply pipe 621 may be somewhat higher than the lowest portion of the storage space 501. In the upper end portion of the first additive supply pipe 621, the opening of the first supply passage 621*a* may be open not only upward but also to the side.

Accordingly, in the upper end portion of the first additive supply pipe 621, the opening of the first supply passage 621*a* may have substantially the same height as the lowest portion of the storage space 501. Therefore, almost all of the additive Ag filled in the storage space 501 may move to the first supply passage 621*a* by gravity.

A pair of sealing members 624 may be interposed between the outer surface of the first additive supply pipe 621 and the inner surface of the additive discharge hole 502. The sealing members 624 may be O-rings. The pair of sealing members 624 may be spaced apart from each other in the vertical direction within the additive discharge hole 502.

Of the pair of sealing members 624, the upper sealing member 624 may be located in the upper end portion of the additive discharge hole 502. Of the pair of sealing members 624, the lower sealing member 624 may be located in the lower end portion of the additive discharge hole 502. The pair of sealing members 624 may doubly prevent leakage of the additive Ag through the space between the outer surface of the first additive supply pipe 621 and the inner surface of the additive discharge hole 502. Therefore, the leakage of the additive Ag through the space between the outer surface of the first additive supply pipe 621 and the inner surface of the additive discharge hole 502 can be blocked.

The second additive supply pipe 622 may define the lower portion of the additive supply pipe 620. The second additive supply pipe 622 may take a form of a circular hollow tube that is long substantially in the vertical direction.

The second additive supply pipe 622 may connect the outlet 611*b* of the additive pump 610 to the additive transfer pipe 640. The second additive supply pipe 622 may provide a passage (hereinafter referred to as a "second supply passage 622*a*") through which the additive Ag discharged from the outlet 611*b* of the additive pump 610 moves to the outside of the pump housing 630. The second supply passage 622*a* may have a long shape substantially in the vertical direction. An outlet insertion portion 622*b* that is inserted into the outlet 611*b* of the additive pump 610 may be provided at the upper portion of the second additive supply pipe 622.

The first supply passage 621*a* and the second supply passage 622*a* may be partitioned by a pipe wall 623. The pipe wall 623 may be located between the heights of the inlet 611*a* and the outlet 611*b* of the additive pump 610. At this time, the pipe wall 623 may be placed at a height closer to the inlet 611*a* than the outlet 611*b* of the additive pump 610. Therefore, almost all of the additive Ag flowing from the storage space 501 into the first supply passage 621*a* may move from the lower end portion of the first supply passage 621*a* toward the inlet 611*a* of the additive pump 610.

The pump housing 630 may accommodate the additive pump 610 therein. The pump housing 630 may be placed lower than under the bottom of the storage space 501. Therefore, the additive pump 610 may be placed lower than the bottom of the storage space 501. Therefore, the additive Ag in the storage space 501 may move to the additive pump 610 by gravity.

The pump housing 630 may include a first accommodation space 631 and a second accommodation space 632 therein. The first accommodation space 631 may refer to a space that accommodates the additive pump 610. The second accommodation space 632 may refer to a space that accommodates the additive motor 613.

The pump housing 630 may include a housing body 633, a first housing cover 634, and a second housing cover 635.

The housing body 633 may include an outer body 633*a* and an intermediate partition 633*b*. The outer body 633*a* may define a first accommodation space 631 and a second accommodation space 632 therein together with the first housing cover 634 and the second housing cover 635. The first accommodation space 631 and the second accommodation space 632 may be partitioned by the intermediate partition 633*b*.

A plurality of protrusions (hereinafter, referred to as a "body protrusions 633*c*") may be formed on the outer body 633*a*. A plurality of protruding locking portions 634*a* may be provided at an edge of the first housing cover 634. With reference to FIG. 12, the first housing cover 634 may move rearward (in a direction opposite to the direction indicated by the Y-axis arrow) so that the protrusion locking portions 634*a* can be caught by the body protrusions 633*c*. Accordingly, the first housing cover 634 can be coupled to the outer body 633*a*. In this case, the first housing cover 634 may close the first accommodation space 631. When the protrusion locking portions 634*a* are spaced apart from the body protrusions 633*c*, the first housing cover 634 can be separated from the outer body 633*a*. Therefore, the first housing cover 634 can open the first accommodation space 631.

When the first housing cover 634 closes the first accommodation space 631, the additive supply pipe 620 may be coupled to the pump housing 630 in the first accommodation space 631.

A first coupling flange 621*d* may be provided on the outer surface of the first additive supply pipe 621. The first coupling flange 621*d* may protrude in the radial direction along the circumferential direction from the outer surface of the first additive supply pipe 621. Partition protrusions 633*d*, which come into close contact with the outer surface of the first additive supply pipe 621, may be provided on the intermediate partition 633*b* and the first housing cover 634. The first additive supply pipe 621 may be coupled to the pump housing 630 by the first coupling flange 621*d* and the partition protrusions 633*d*.

In the state in which the partition protrusions 633*d* are in close contact with the outer surface of the first additive supply pipe 621, the partition protrusions 633*d* may provide a vertical movement boundary of the first coupling flange 621*d*. Therefore, even if external force or vibration is transferred to the pump housing 630, the relative movement between the first additive supply pipe 621 and the pump housing 630 can be blocked. Therefore, the inlet insertion portion 621*b* can be firmly maintained in the inlet 611*a* of the additive pump 610 inside the pump housing 630.

A second coupling flange may be provided on the outer surface of the second additive supply pipe 622. The second coupling flange may protrude in the radial direction along the circumferential direction from the outer surface of the second additive supply pipe 622. The partition protrusions 633*d*, which come into close contact with the outer surface of the second additive supply pipe 622, may be provided on the intermediate partition 633*b*. The second additive supply pipe 622 may be coupled to the pump housing 630 by the second coupling flange and the partition protrusions 633*d*.

In the state in which the partition protrusions 633*d* are in close contact with the outer surface of the second additive supply pipe 622, the partition protrusions 633*d* may provide a vertical movement boundary of the second coupling flange. Therefore, even when external force or vibration is transferred to the pump housing 630, the relative movement between the second additive supply pipe 622 and the pump housing 630 can be blocked. Therefore, the outlet insertion portion 622*b* can be firmly maintained in the outlet 611*b* of the additive pump 610 inside the pump housing 630.

When the first housing cover 634 closes the first accommodation space 631, the additive pump 610 may be coupled to the pump housing 630 in the first accommodation space 631.

Close contact ribs 633*e*, which come into close contact with the outer surface of the additive pump 610, may be provided on the intermediate partition 633*b* and the first housing cover 634. In the state in which the close contact ribs 633*e* are in close contact with the outer surface of the additive pump 610 in the first accommodation space 631, the close contact ribs 633*e* may define a movement boundary of the additive pump 610. Therefore, even when external force or vibration is transferred to the pump housing 630, the relative movement between the additive pump 610 and the pump housing 630 can be blocked. Therefore, the relative movement of the additive supply pipe 620 and the additive pump 610 within the pump housing 630 can be blocked.

A plurality of protruding locking portions 635*a* may be provided at an edge of the second housing cover 635. With reference to FIG. 12, the second housing cover 635 may move forward (in the direction indicated by the Y-axis arrow) so that the protrusion locking portions 635*a* can be caught by the body protrusions 633*c*. Accordingly, the second housing cover 635 can be coupled to the outer body 633*a*. At this time, the second housing cover 635 may close the second accommodation space 632. When the protrusion locking portions 635*a* are spaced apart from the body protrusions 633*c*, the second housing cover 635 can be separated from the outer body 633*a*. Therefore, the second housing cover 635 can open the second accommodation space 632.

When the second housing cover 635 closes the second accommodation space 632, the additive pump 613 and a motor connector 613*a* may be coupled to the pump housing 630 in the second accommodation space 632. The motor connector 613*a* may be electrically connected to the additive motor 613 by an electric wire. A socket may be connected to the motor connector 613*a*. The socket may be connected to the controller 40. Therefore, a signal from the controller 40 and power may be transmitted to the additive motor 613.

Close contact ribs 633*e*, which come into close contact with the outer surface of the additive motor 613, may be provided on the intermediate partition 633*b* and the second housing cover 635. In the state in which the close contact ribs 633*e* are in close contact with the outer surface of the additive motor 613 in the second accommodation space 632, the close contact ribs 633*e* may define a movement boundary of the additive pump 613. Therefore, even when external force or vibration is transferred to the pump housing 630, the relative movement between the additive motor 613 and the pump housing 630 can be blocked. Therefore, the relative movement of the additive motor 613 inside the pump housing 630 can be blocked.

The first housing cover 634 may be coupled to the lower portion of the additive storage part 500. A first cover fastening portion 634*b* may be provided on the first housing cover 634, and a first storage unit fastening portion 504 may be provided on the lower portion of the additive storage portion 500. The first cover fastening portion 634*b* may be coupled to the first storage unit fastening portion 504. As an example, the first cover fastening portion 634*b* and the first storage unit fastening portion 504 may be detachably coupled to each other with a quick release buckle structure.

The second housing cover 635 may be coupled to the lower portion of the additive storage part 500. A second cover fastening portion 635*b* may be provided on the second housing cover 635, and a second storage unit fastening portion 505 may be provided on the lower portion of the additive storage part 500. The second cover fastening portion 635*b* may be coupled to the second storage unit fastening portion 505. As an example, the second cover fastening portion 635*b* and the second storage unit fastening portion 505 may be detachably coupled to each other with a bolt fastening structure.

The first housing cover 634 and the second housing cover 635 may be coupled to the lower portion of the additive storage part 500 from opposite sides with respect to the first additive supply pipe 621. Therefore, even when external force or vibration is transferred to the pump housing 630, the relative movement between the additive storage part 500 and the pump housing 630 can be blocked on both sides with the first additive supply pipe 621 interposed therebetween. Therefore, the state in which the first additive supply pipe 621 is coupled to the additive storage part 500 can be firmly maintained. Therefore, the leakage of the additive Ag through the space between the outer surface of the first additive supply pipe 621 and the inner surface of the additive discharge hole 502 can be blocked.

The additive pump 610 may press the additive Ag introduced into the first supply passage 621*a* toward the second supply passage 622*a*. The additive pump 610 may be disposed below the additive storage part 500. Therefore, the additive Ag in the storage space 501 may move to the additive pump 610 by gravity.

The additive pump 610 may include an additive tube 611, a pump cover 617, a rotating roller 612, an additive motor 613, and a power shaft 614.

The additive tube 611 is made of a tube made of an elastically deformable material. The additive tube 611 may include an inlet 611*a* and an outlet 611*b*. The additive tube 611 may be bent between the inlet 611*a* and the outlet 611*b*. As an example, the additive tube 611 may be bent substantially in a "⊂" shape of between the inlet 611*a* and the outlet 611*b*.

The additive tube 611 may provide a passage (hereinafter, referred to as a "flexible passage") through which the additive Ag flowing into the inlet 611*a* moves to the outlet 611*b*. The inlet 611*a* of the additive tube 611 may be connected to the first supply passage 621*a*. The outlet 611*b* may be connected to the second supply passage 622*a*.

An inlet insertion portion 621*b* may be provided in the lower portion of the first additive supply pipe 621. The inlet insertion portion 621*b* may have a circular tube shape. The inlet insertion portion 621*b* may be inserted into the inlet 611*a* of the additive tube 611. The inlet insertion portion 621*b* may connect the first supply passage 621*a* to the flexible passage.

The outer diameter of the inlet insertion portion 621*b* may be larger than the inner diameter of the inlet 611*a*. Therefore, while the inlet 611*a* is elastically deformed, the inlet insertion portion 621*b* may be forcibly inserted into the inlet 611*a* of the additive tube 611. A protrusion may be provided on the outer surface of the inlet insertion portion 621*b*. The protrusion may protrude radially along the circumferential direction. Therefore, the amount of elastic deformation of the inlet 611*a* may increase at the protrusion. Therefore, the inlet insertion portion 621*b* can be firmly maintained in the inlet 611*a* of the additive pump 610 inside the pump housing 630.

An outlet insertion portion 622*b* may be provided on the upper portion of the second additive supply pipe 622. The outlet insertion portion 622*b* may have a circular tube shape. The outlet insertion portion 622*b* may be inserted into the outlet 611*b* of the additive tube 611. The outlet insertion portion 622*b* may connect the second supply passage 622*a* to the flexible passage.

The outer diameter of the outlet insertion portion 622*b* may be larger than the inner diameter of the outlet 611*b*. Therefore, while the outlet 611*b* is elastically deformed, the outlet insertion portion 622*b* may be forcibly inserted into the outlet 611*b* of the additive tube 611. A protrusion may be provided on the outer surface of the outlet insertion portion 622*b*. The protrusion may protrude radially along the circumferential direction. Therefore, the amount of elastic deformation of f the outlet 611*b* may increase at the protrusion. Therefore, the outlet insertion portion 622*b* can be firmly maintained in the outlet 611*b* of the additive pump 610 inside the pump housing 630.

As described above, the first additive supply pipe 621 and the second additive supply pipe 622 may be manufactured as one piece to have a circular hollow tube shape that is long substantially in the vertical direction. Therefore, the arrangement of the additive tube 611 can be optimized by placing the additive tube 611 on one side of the additive supply pipe 620. For example, with respect to the additive supply pipe 620, the additive tube 611 may be placed in the direction indicated by the X-axis arrow. In this case, the additive pump 610 and pump housing 630 can be efficiently placed in the space below the additive storage part 500 by providing the additive discharge hole 502 on a relatively left side (opposite to the direction indicated by the X-axis arrow) in the lower portion of the first additive storage part 510 with respect to the X-axis.

The first additive supply pipe 621 and the inlet 611*a* may be connected at a predetermined angle. As an example, the inlet insertion portion 621*b* may protrude from the lower portion of the first additive supply pipe 621 in the direction of the X-axis arrow, and the first additive supply pipe 621 and the inlet 611*a* may be connected at an angle of about 90 degrees.

The second additive supply pipe 622 and the outlet 611*b* may be connected at a predetermined angle. As an example, the outlet insertion portion 622*b* may protrude from the upper portion of the second additive supply pipe 622 in the direction of the X-axis arrow, and the second additive supply pipe 622 and the outlet 611*b* may be connected at an angle of about 90 degrees.

Figure 14:
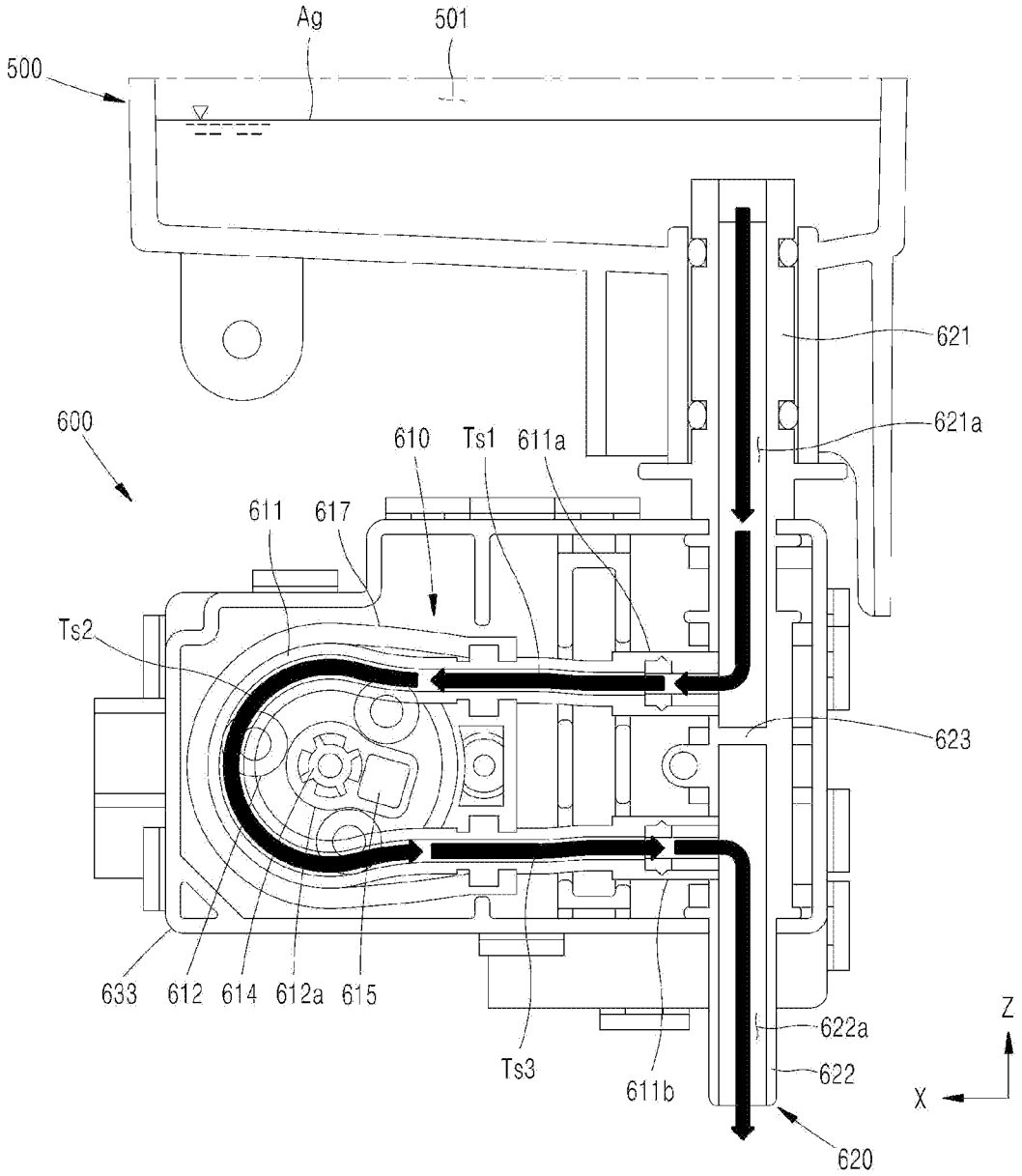
FIG. 14 is a cross-sectional view taken along line A-A' of FIG. 11, illustrating the flow of an additive.

FIG. 14 is a cross-sectional view taken along line A-A' of FIG. 11, illustrating the flow of an additive.

The additive tube 611 may be divided into an inflow section Ts1, a pressing section Ts2, and a discharge section Ts3 along the longitudinal direction. The pressing section Ts2 may be a section in which the rotating roller 612 presses the additive Ag toward the outlet 611*b*. The inflow section Ts1 may be a section in which the additive Ag flowing into the inlet 611*a* moves toward the pressing section Ts2. The discharge section Ts3 may be a section in which the additive Ag that has passed the pressing section Ts2 moves toward the outlet 611*b*.

The pump cover 617 may accommodate the pressing section Ts2 of the additive tube 611 therein. The pressing section Ts2 of the additive tube 611 may be arranged along the circumferential direction around the roller central shaft 621*a* inside the pump cover 617. The inner surface of the pump cover 617 may come into contact with the pressing section Ts2 of the additive tube 611 on the opposite side to the roller central shaft 621*a*. A radially expanded portion (hereinafter, referred to as a "tube expansion portion") may be provided on the outer surface of the additive tube 611 in the inflow section Ts1 and the discharge section Ts3. The tube expansion portion may be inserted and coupled to the pump cover 617. Accordingly, the pressing section Ts2 of the additive tube 611 can be maintained in the state of being arranged along the circumferential direction around the roller central shaft 621*a*.

The pump cover 617 may accommodate the rotating roller 612 and the pressing section Ts2 of the additive tube 611 therein. The pressing section Ts2 of the additive tube 611 may be disposed in the rotating path of the rotating roller 612. Therefore, the rotating roller 612 may pressing the pressing section Ts2 of the additive tube 611 while being rotated by the additive motor 613. With reference to FIG. 14, the rotating roller 612 may press the pressing section TS2 of the additive tube 611 while rotating counterclockwise. Therefore, the additive Ag in the flexible passage can move from the pressing section Ts2 to the discharge section Ts3. In this case, the additive Ag in the flexible passage can move from the inflow section Ts1 to the pressing section Ts2.

The torque of the additive motor 613 may be transferred to the central shaft of the rotating roller 612 (hereinafter, referred to as a "roller central shaft 621*a*") by the power shaft 614. The roller central shaft 621*a* may be rotatably coupled to the pump cover 617. For example, with respect to the additive supply pipe 620, the additive tube 611 may be placed in the direction indicated by the X-axis arrow, and the roller center shaft 621*a* and the power shaft 614 may be arranged parallel to the Y-axis direction.

The power shaft 614 may be provided between the heights of the inlet 611*a* and the outlet 611*b*. Therefore, the inflow section Ts1, the pressing section Ts2, and the discharge section Ts3 of the additive tube 611 may be arranged between the heights of the inlet 611*a* and the outlet 611*b*. In addition, the inflow section Ts1 may be connected to the first additive supply pipe 621 at substantially the shortest distance. For example, the inflow section Ts1 may be arranged substantially parallel to the X-axis. Therefore, almost all of the additive Ag in the inflow section Ts1 can move to the pressing section Ts2 by gravity without remaining in the inflow section Ts1. In addition, the discharge section Ts3 may be connected to the second additive supply pipe 622 at substantially the shortest distance. For example, the discharge section Ts3 may be arranged substantially parallel to the X-axis. Therefore, almost all of the additive Ag in the discharge section Ts3 can move to the second supply passage 622*a* by gravity without remaining in the discharge section Ts3.

As described above, the additive pump 610 may be coupled to the pump housing 630 in the first accommodation space 631. In addition, the additive motor 613 may be coupled to the pump housing 630 in the second accommodation space 632. The power shaft 614 may pass through the intermediate partition 633*b* and may be coupled to the roller central shaft 621*a*. The power shaft 614 may be rotatably coupled to the intermediate partition 633*b* and/or the second housing cover 635.

The shaft of the additive motor 613 (hereinafter, referred to as a "motor shaft") and the power shaft 614 may be connected to each other by a gear. For example, the power shaft 614 may be arranged parallel to the Y-axis direction, and the motor shaft may be arranged parallel to the X-axis direction. In addition, the motor shaft and power shaft 614 may be connected to each other by a worm and a worm gear. The worm may be provided on the motor shaft, and the worm gear may be provided on the power shaft 614.

Transmission of motion from the worm to the worm gear is possible, but transmission of motion from the worm gear to the worm is not possible. Therefore, the rotation of the power shaft 614 can be blocked when the motor shaft is stopped (when the controller 40 does not operate the additive motor 613). Therefore, the rotation of the rotating roller 612 due to unintentional recovery of elasticity of the additive tube 611 or pressure change in the flexible passage can be prevented. Therefore, the controller 40 can block the additive Ag from moving into the tub 100 when the additive motor 613 does not operate.

There may be a plurality of rotating rollers 612. The rotating rollers 612 may be spaced apart from the roller central shaft 621*a* in the radial direction, and the rotating shaft of each rotating roller 612 (hereinafter, referred to as a "roller shaft 612*b*") may be coupled to the roller central shaft 621*a*. Therefore, the rotating rollers 612 can rotate along the circumferential direction around the roller central shaft 621*a*. For example, three rotating rollers 612 may be provided, and the rotating rollers 612 may form an angle of 120 degrees with each other around the roller central shaft 621*a*.

Figure 15:
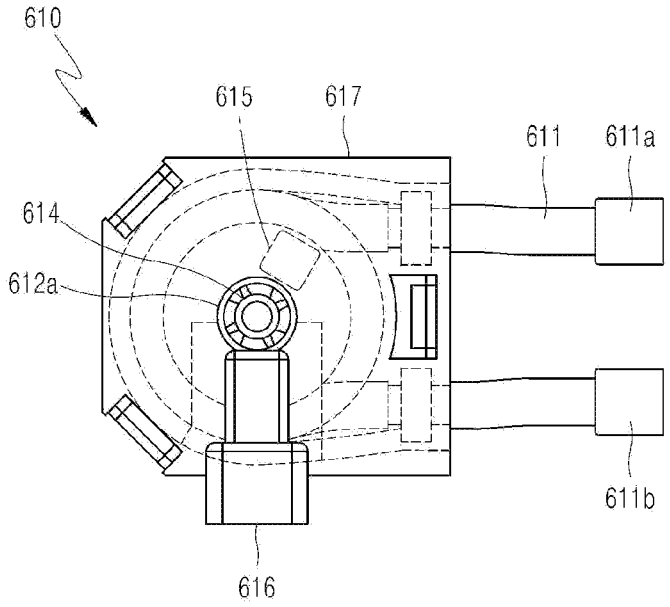
FIG. 15 is a view illustrating a magnetic force member and a magnetic force detector of the additive pump of FIG. 12.

FIG. 15 is a view illustrating the magnetic member 615 and the magnetic force detector 616 of the additive pump 610 of FIG. 12.

The additive pump 610 may include a magnetic force member 615 and a magnetic force detector 616.

The magnetic member 615 may be provided with a permanent magnet. The magnetic member 615 may be spaced apart from the roller central shaft 621*a* in the radial direction and may be coupled to the roller central shaft 621*a*. Therefore, the magnetic member 615 can rotate along the circumferential direction around the roller central shaft 621*a* together with the rotating roller 612 by the additive motor 613.

The magnetic force detector 616 may detect the magnetic force member 615. A detector insertion portion may be provided in the housing body 633. The magnetic force detector 616 may be inserted into the detector insertion portion. The magnetic force detector 616 may be provided on one side of the rotation path of the magnetic member 615 centered on the roller central shaft 621*a* while being inserted into the detector insertion portion.

The magnetic force detector 616 may be configured with a Hall sensor. The magnetic force detector 616 may detect the magnetic force member 615 on one side of the rotation path of the magnetic force member 615 centered on the roller central shaft 621*a*. The magnetic force detector 616 may be connected to the controller 40. Therefore, the controller 40 may detect the rotation of the rotating roller 612 by the magnetic force detector 616. The controller 40 may control the input amount of the additive Ag by a signal from the magnetic force detector 616. For example, the controller 40 may stop the additive motor 613 when receiving a signal from the magnetic force detector 616 N times after rotating the additive motor 613. Therefore, the controller 40 can precisely control the amount of additive Ag supplied into the tub 100.

Figure 16:
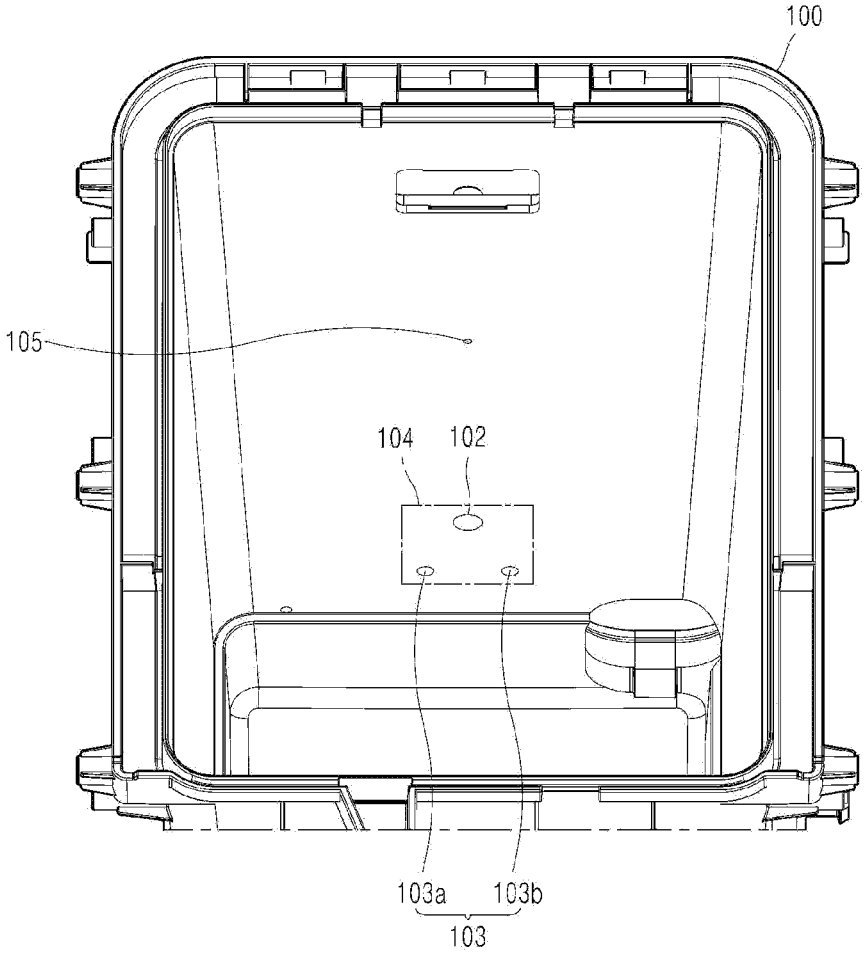
FIG. 16 is a view of a washing space inside the tub of FIG. 6 viewed from a front upper side.

FIG. 16 is a view of a washing space inside the tub 10 of FIG. 6 viewed from a front upper side.

Figure 17:
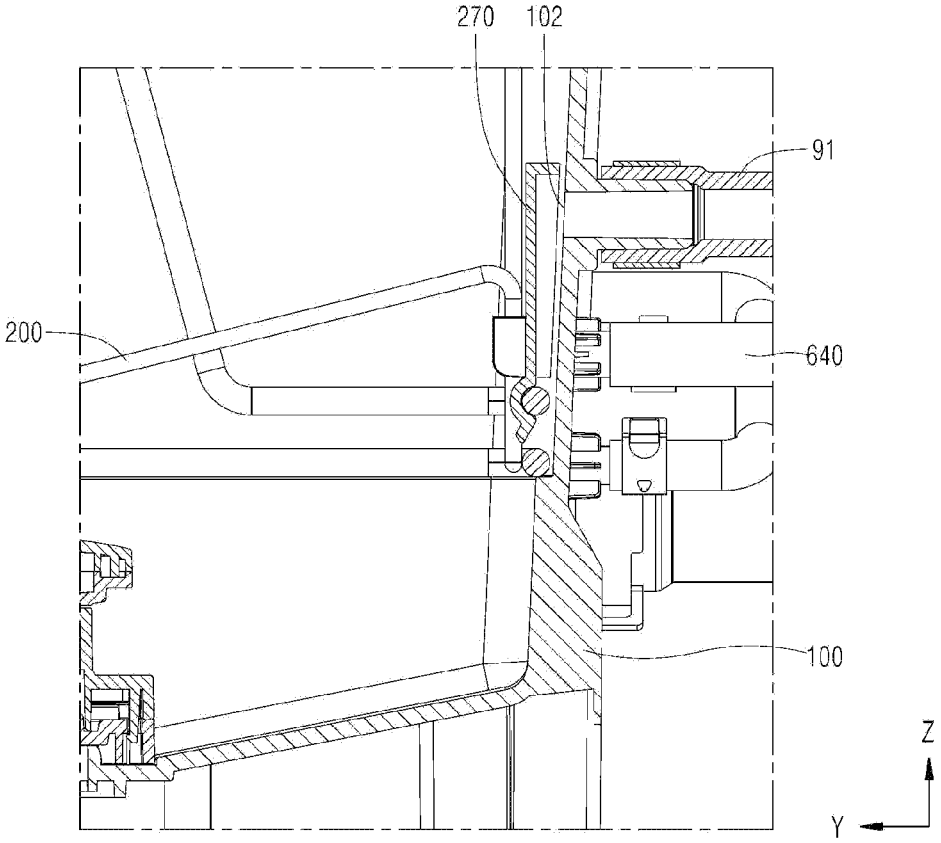
FIG. 17 is a partial enlarged view of FIG. 6, illustrating a washing water inflow pipe and an additive transfer pipe.

FIG. 17 is a partial enlarged view of FIG. 6, illustrating a washing water inflow pipe and an additive transfer pipe 640.

The additive transfer pipe 640 may connect the second additive supply pipe 622 to the tub 100. The additive transfer pipe 640 may be connected to the tub 100 below the outlet 611*b*. Therefore, the additive transfer pipe 640 can supply the additive Ag into the tub 100 from below the outlet 611*b*. Therefore, almost all of the additive Ag discharged from the additive pump 610 to the second supply passage 622*a* can move into the tub 100 by gravity.

The additive transfer pipe 640 may be connected to the additive inlet 103 on the inner wall of the tub 100. That is, the additive supply part 600 may supply the additive Ag into the tub 100 through the additive inlet 103. The washing water supply part 90 may supply water to a specific region (hereinafter, referred to as a "first region 104") on the inner wall of the tub 100. The additive inlet 103 may be provided in the first region 104 of the inner wall of the tub 100. The first region 104 may be located between the first additive supply part 600*a* and the second additive supply part 600*b* with respect to the X-axis.

The additive transfer pipe 640 may include a first additive transfer pipe 641 and a second additive transfer pipe 642 (see FIG. 9).

The first additive transfer pipe 641 may connect the second additive supply pipe 622 of the first additive supply part 600*a* to the tub 100. The first additive transfer pipe 641 may be connected to the tub 100 below the outlet 611*b*. Therefore, the first additive transfer pipe 641 can supply the first additive Ag1 into the tub 100 from below the outlet 611*b*. Accordingly, almost all of the additive Ag discharged from the additive pump 610 of the first additive supply part 600*a* to the second supply passage 622*a* can move into the tub 100 by gravity.

The first additive transfer pipe 641 may be connected to the first additive inlet 103*a* on the inner wall of the tub 100. That is, the first additive supply part 600*a* may supply the first additive Ag1 into the tub 100 through the first additive inlet 103*a*. The first additive inlet 103*a* may be provided in the first region 104 of the inner wall of the tub 100.

The second additive transfer pipe 642 may connect the second additive supply pipe 622 of the second additive supply part 600*b* to the tub 100. The second additive transfer pipe 642 may be connected to the tub 100 below the outlet 611*b*. Therefore, the second additive transfer pipe 642 can supply the second additive Ag2 into the tub 100 from below the outlet 611*b*. Accordingly, almost all of the additive Ag discharged from the additive pump 610 of the second additive supply part 600*a* to the second supply passage 622*a* can move into the tub 100 by gravity.

The second additive transfer pipe 642 may be connected to the second additive inlet 103*a* on the inner wall of the tub 100. That is, the second additive supply part 600*b* may supply the second additive Ag2 into the tub 100 through the second additive inlet 103*b*. The second additive inlet 103*b* may be provided in the first region 104 of the inner wall of the tub 100.

As described above, the first region 104 may be located between the first additive supply part 600*a* and the second additive supply part 600*b* with respect to the X-axis. The first additive Ag1 may be provided as a detergent. The second additive Ag2 may be provided as a conditioner. When washing the cup C, a smaller amount of the conditioner than the detergent (about 0.2 times the amount of the detergent) may be required. The second additive transfer pipe 642 may have a shorter length than the first additive transfer pipe 641. Therefore, even when the second additive Ag2 is supplied in a smaller amount than the first additive Ag1, almost all of the second additive Ag2 can move into the tub 100 rather than remaining inside the second additive transfer pipe 642.

As described above, the water in the water reservoir 50 may be supplied into the tub 100 through the washing water supply part 90 (see FIG. 7). The washing water supply part 90 may include a washing water supply pipe 91 and an opening/closing valve 92. The controller 40 may control the opening/closing valve 92.

The washing water supply pipe 91 may be connected to a washing water inlet 102 on the inner wall of the tub 100. The washing water inlet 102 may be located above the additive inlet 103 within the first region 104. The water discharged from the washing water inlet 102 may fall toward the additive inlet 103 by gravity. Accordingly, the washing water supply part 90 can supply water to the first region 104.

The first additive inlet 103*a* and the second additive inlet 103*b* may be spaced apart from each other in the horizontal direction within the first region 104. With respect to the X-axis, the first additive inlet 103*a* and the second additive inlet 103*b* may be spaced apart from the washing water inlet 102 at equal intervals in the horizontal direction. Accordingly, the first additive Ag1 discharged from the first additive inlet 103*a* into the tub 100 may be mixed with the water discharged from the washing water inlet 102. In addition, the first additive Ag2 discharged from the second additive inlet 103*b* into the tub 100 may be mixed with the water discharged from the washing water inlet 102.

A mixing guide 270 may be provided in front of the first region 104 in the washing space. The mixing guide 270 may be detachably coupled to the rack 200. The mixing guide 270 may guide the water flowing into the tub 100 through the washing water inlet 102 toward the additive inlet 103. The mixing guide 270 may define a space (hereinafter, referred to as a "mixing space 270*a*") in which water is mixed with the additive Ag while moving between the first region 104 and the mixing guide 270. The mixing space 270*a* may be provided in front of the first region 104.

A gap may be provided between the mixing guide 270 and the inner wall of the tub 100 below the mixing guide 270. Therefore, the water discharged from the washing water inlet 102 may pass through the first region 104 and may fall from the lower portion of the mixing guide 270 into the tub 100. The water discharged from the washing water inlet 102 may form a constant flow rate in the mixing space 270*a*. Therefore, the additive Ag discharged into the tub 100 from the additive inlet 103 can be quickly mixed with the water discharged from the washing water inlet 102 in the mixing space 270*a*.

Although specific embodiments of the present disclosure have been described and illustrated above, it is evident to a person ordinarily skilled in the art that the present disclosure is not limited to the described embodiments, and various changes s and modifications can be made without departing from the technical idea and scope of the present disclosure. Accordingly, such modifications or variations should not be understood individually from the technical spirit and viewpoint of the present disclosure, and the modifications and variations should be deemed to fall within the scope of the claims of the present disclosure.

What is claimed is:

1. A cup washer configured to wash a cup by spraying water into a tub, the cup washer comprising:

an additive storage part configured to store an additive in a storage space; and an additive supply part configured to supply the additive into the tub, wherein the additive supply part comprises:

an additive pump disposed below the additive storage part;

a first additive supply pipe configured to connect a lower portion of the additive storage part to an inlet of the additive pump to provide a first supply passage through which the additive of the additive storage part moves toward the inlet of the additive pump; and a second additive supply pipe connected to an outlet of the additive pump to provide a second supply passage through which the additive discharged from the outlet of the additive pump located under the inlet moves, wherein the first additive supply pipe and the inlet are connected at a predetermined angle, wherein the first additive supply pipe and the second additive supply pipe are configured as a single supply pipe, and wherein the first supply passage and the second supply passage are partitioned by a pipe wall located between heights of the inlet and the outlet.

2. The cup washer of claim 1, wherein the additive supply part comprises a pump housing disposed lower than a bottom of the storage space and configured to accommodate the additive pump therein, and wherein the first additive supply pipe is coupled to the additive storage part and the pump housing.

3. The cup washer of claim 2, wherein the additive storage part has an additive discharge hole provided in a lower thereof, the first additive supply pipe being vertically inserted into the additive discharge hole, and wherein a pair of sealing members is interposed between an outer surface of the first additive supply pipe and an inner surface of the additive discharge hole, wherein the pair of sealing members are vertically spaced apart from each other within the additive discharge hole.

4. The cup washer of claim 2, wherein the additive discharged from the outlet of the additive pump located under the inlet moves to an outside of the pump housing, and wherein the second additive supply pipe and the outlet are connected at a predetermined angle.

5. The cup washer of claim 4, wherein the additive pump comprises:

an additive tube comprising the inlet and the outlet; and a rotating roller configured to rotate by an additive motor to pressurize the additive tube, and wherein a power shaft configured to transmit torque of the additive motor to the rotating roller is provided between heights of the inlet and the outlet.

6. The cup washer of claim 5, wherein the additive tube has a shape bent between the inlet and the outlet.

7. The cup washer of claim 5, wherein the pump housing comprises:

a housing body comprising an intermediate partition through which the power shaft passes, wherein the intermediate partition is configured to partition a first accommodation space configured to accommodate the additive pump and a second accommodation space configured to accommodate the additive motor;

a first housing cover configured to open and close the first accommodation space; and a second housing cover configured to open and close the second accommodation space.

8. The cup washer of claim 7, wherein the first housing cover and the second housing cover are coupled to a lower portion of the additive storage part from opposite sides with respect to the first additive supply pipe.

9. The cup washer of claim 5, wherein the additive pump comprises:

a magnetic force member configured to rotate by the additive motor; and a magnetic force sensor provided on one side of a rotation path of the magnetic force member to detect the rotation of the rotating roller, and wherein an input amount of the additive is controlled by a signal from the magnetic force sensor.

10. The cup washer of claim 4, wherein the second additive supply pipe is coupled to the pump housing.

11. The cup washer of claim 1, wherein the pipe wall is disposed at a height closer to the inlet than the outlet.

12. The cup washer of claim 1, wherein the first additive supply pipe and the inlet are connected to each other at an angle of 90 degrees, and wherein the second additive supply pipe and the outlet are connected to each other at an angle of 90 degrees.

13. The cup washer of claim 1, wherein the additive supply part comprises an additive transfer pipe configured to connect the second additive supply pipe to the tub to supply the additive into the tub from below the outlet.

14. The cup washer of claim 1, wherein the additive supply part is configured to supply the additive into the tub through an additive inlet provided in a first region of an inner wall of the tub, and wherein the cup washer further comprises a washing water supply part configured to supply water to the first region.

15. The cup washer of claim 1, wherein the additive storage part comprises:

a first additive storage part configured to store a first additive in a first storage space; and a second additive storage part configured to store a second additive in a second storage space, wherein the additive supply part comprises:

a first additive supply part configured to supply the first additive to into the tub; and a second additive supply part configured to supply the second additive into the tub, and wherein the cup washer further comprises a controller configured to individually control the first additive supply part and the second additive supply part.

16. The cup washer of claim 15, wherein the first additive supply part is configured to supply the first additive into the tub through a first additive inlet provided in a first region of an inner wall of the tub, and wherein the second additive supply part is configured to supply the second additive into the tub through a second additive inlet provided in the first region.

* * * * *